US009623677B2

(12) United States Patent
Nakai et al.

(10) Patent No.: US 9,623,677 B2
(45) **Date of Patent: *Apr. 18, 2017**

(54) PRINTING APPARATUS AND PRINTED MATERIAL MANUFACTURING METHOD

(71) Applicants: Junji Nakai, Kanagawa (JP); Hiroyoshi Matsumoto, Kanagawa (JP); Masakazu Yoshida, Kanagawa (JP); Souichi Nakazawa, Kanagawa (JP); Tatsuro Watanabe, Kanagawa (JP); Hiroyuki Hiratsuka, Kanagawa (JP); Koji Nagai, Kanagawa (JP)

(72) Inventors: Junji Nakai, Kanagawa (JP); Hiroyoshi Matsumoto, Kanagawa (JP); Masakazu Yoshida, Kanagawa (JP); Souichi Nakazawa, Kanagawa (JP); Tatsuro Watanabe, Kanagawa (JP); Hiroyuki Hiratsuka, Kanagawa (JP); Koji Nagai, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/988,394

(22) Filed: Jan. 5, 2016

(65) Prior Publication Data

US 2016/0167402 A1 Jun. 16, 2016

Related U.S. Application Data

(63) Continuation of application No. 14/029,627, filed on Sep. 17, 2013, now Pat. No. 9,259,924.

(30) Foreign Application Priority Data

Sep. 18, 2012 (JP) ..... 2012-205090
Sep. 18, 2012 (JP) ..... 2012-205092
(Continued)

(51) Int. Cl.
*B41J 2/15* (2006.01)
*B41J 11/00* (2006.01)
*B41J 2/07* (2006.01)

(52) U.S. Cl.
CPC ..... *B41J 11/002* (2013.01); *B41J 2/07* (2013.01); *B41J 11/0015* (2013.01)

(58) Field of Classification Search
CPC . B41J 29/393; B41J 29/38; B41J 11/42; B41J 29/02; B41J 2/04505
See application file for complete search history.

(56) References Cited

U.S. PATENT DOCUMENTS 8,366,260 B2 * 2/2013 Gauss ..... B41J 3/407 347/101
8,967,784 B2 * 3/2015 Ram ..... B41J 11/0015 347/101
(Continued)

FOREIGN PATENT DOCUMENTS

JP 04-359071 12/1992
JP 11-321073 11/1999
(Continued)

*Primary Examiner* — Lamson Nguyen
(74) *Attorney, Agent, or Firm* — Duft Bornsen & Fettig, LLP

(57) ABSTRACT

A printing apparatus includes a plasma treatment unit that performs plasma treatment on a surface of a treatment object to acidify at least the surface of the treatment object; and a recording unit that performs inkjet recording on the surface of the plasma treatment subjected to the plasma treatment by the plasma treatment unit.

18 Claims, 22 Drawing Sheets

(30) Foreign Application Priority Data

| | | |
|---|---|---|
| Aug. 9, 2013 | (JP) | 2013-166976 |
| Sep. 12, 2013 | (JP) | 2013-189636 |
| Sep. 12, 2013 | (JP) | 2013-189637 |

(56) References Cited

U.S. PATENT DOCUMENTS

| | | | | |
|---|---|---|---|---|
| 8,998,374 | B2 * | 4/2015 | Hoshino | B41J 2/14209 347/20 |
| 9,259,924 | B2 * | 2/2016 | Nakai | B41J 2/07 |
| 2005/0123696 | A1 | 6/2005 | Campbell et al. | |
| 2007/0106962 | A1 | 5/2007 | Sakakibara et al. | |
| 2008/0170982 | A1 | 7/2008 | Zhang et al. | |
| 2009/0290007 | A1 | 11/2009 | Saitoh et al. | |
| 2013/0250017 | A1 | 9/2013 | Saitoh et al. | |

FOREIGN PATENT DOCUMENTS

| | | |
|---|---|---|
| JP | 2000-301711 | 10/2000 |
| JP | 2003-261799 | 9/2003 |
| JP | 2007-512985 | 5/2007 |
| JP | 2007-307885 | 11/2007 |
| JP | 2008-523254 | 7/2008 |
| JP | 2009-091528 | 4/2009 |
| JP | 2009-279796 | 12/2009 |
| JP | 2011-060737 | 3/2011 |
| JP | 2011-167968 | 9/2011 |

* cited by examiner

FIG.17

| RESOLUTION | DOT SIZE | SIZE OF DROPLET [pl] | SHEET TYPE | | | | | | |
|---|---|---|---|---|---|---|---|---|---|
| | | | PLAIN PAPER A | PLAIN PAPER B | COATED PAPER A | COATED PAPER B | COATED PAPER C | FILM A | FILM B |
| 600 dpi | SMALL | 2.5 | 0.07 | 0.1 | 0.14 | 0.5 | 1 | 0.07 | 0.14 |
| | MIDDLE | 6.5 | 0.08 | 0.12 | 0.7 | 1.4 | 2.8 | 0.08 | 0.16 |
| | LARGE | 15 | 0.1 | 0.14 | 1.4 | 2.5 | 5 | 0.1 | 0.2 |
| 1200 dpi | SMALL | 2 | 0.07 | 0.1 | 0.14 | 0.5 | 1 | 0.07 | 0.14 |
| | MIDDLE | 4 | 0.08 | 0.12 | 0.7 | 1.4 | 2.8 | 0.08 | 0.16 |
| | LARGE | 6 | 0.08 | 0.12 | 0.7 | 1.4 | 2.8 | 0.08 | 0.16 |

PRINTING APPARATUS AND PRINTED MATERIAL MANUFACTURING METHOD

CROSS-REFERENCE TO RELATED APPLICATIONS

This patent application is a continuation of co-pending U.S. patent application Ser. No. 14/029,627 (Filed on Sep. 17, 2013) titled "PRINTING APPARATUS AND PRINTED MATERIAL MANUFACTURING METHOD," which is hereby incorporated by reference. The present application also claims priority to and incorporates by reference the entire contents of Japanese Patent Application No. 2012-205092 filed in Japan on Sep. 18, 2012, Japanese Patent Application No. 2012-205090 filed in Japan on Sep. 18, 2012, Japanese Patent Application No. 2013-166976 filed in Japan on Aug. 9, 2013, Japanese Patent Application No. 2013-189636 filed in Japan on Sep. 12, 2013, and Japanese Patent Application No. 2013-189637 filed in Japan on Sep. 12, 2013.

BACKGROUND OF THE INVENTION

1. Field of the Invention

The present invention relates to a printing apparatus and a printed material manufacturing method.

2. Description of the Related Art

In conventional inkjet recording apparatuses, it is difficult to improve throughput for high-speed printing because a shuttle head that shuttles in a width direction of a recording medium, such as a sheet of paper or a film, is generally used. Therefore, in recent years, to cope with the high-speed printing, a single-pass system has been proposed, in which a plurality of heads are arranged so as to cover the entire width of the recording medium and enable printing with the heads at once.

However, while the single-pass system is advantageous to increase print speed, a time interval between dropping of adjacent dots is short and an adjacent dot is dropped before the ink of a previously-dropped dot penetrates into the recording medium. Therefore, coalescence of the adjacent dots (in other words, droplet interference) occurs, so that beading or bleed may occur with which the image quality is reduced.

Furthermore, if an inkjet printing apparatus prints an image on an impermeable medium or a low-permeable medium, such as a film or a coated paper, adjacent dots move and coalesce together, resulting in an image failure, such as beading or bleed. As a conventional technology to solve the above situations, some methods have been proposed; for example, a method to apply primer to a recording medium in advance to improve the cohesiveness and the fixability of ink and a method to use ultraviolet (UV) curable ink.

However, in the method to apply primer to the print media in advance, it is necessary to evaporate and dry moisture of the primer in addition to moisture of the ink. Therefore, a longer drying time or a larger drying device is needed. Furthermore, because the primer is a supply, printing costs increase. Moreover, if a treatment liquid is a highly acidic liquid, irritating odor of the liquid may become a problem. In the method to use the UV curable ink, the cost for the UV curable ink is higher than the cost for aqueous ink, so that printing costs further increase. Furthermore, the UV curable ink itself initiates a chemical reaction and is cured; therefore, while the weather resistance and the resistance against flaking can be improved, the reaction needs to be controlled with higher accuracy and handling becomes difficult.

SUMMARY OF THE INVENTION

According to an embodiment, there is provided a printing apparatus that includes a plasma treatment unit that performs plasma treatment on a surface of a treatment object to acidify at least the surface of the treatment object; and a recording unit that performs inkjet recording on the surface of the treatment object subjected to the plasma treatment by the plasma treatment unit.

According to another embodiment, there is provided a printing apparatus that includes a plasma treatment unit that performs plasma treatment on a surface of a treatment object to increase a penetration ratio of at least the surface of the treatment object; and a recording unit that performs inkjet recording on the surface of the treatment object subjected to the plasma treatment by the plasma treatment unit.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 17 is a diagram illustrating an example of a table used to specify the size of an ink droplet and plasma energy in the flowchart illustrated in FIG. 16;

DETAILED DESCRIPTION OF THE PREFERRED EMBODIMENTS

Exemplary embodiments of the present invention will be explained in detail below with reference to the accompanying drawings. The embodiments below are described as preferable embodiments of the present invention, and therefore, various technically-preferable limitations are applied. However, the scope of the present invention is not unreasonably limited by the descriptions below. Furthermore, not all of the constituent elements described in the embodiments is necessary to embody the present invention.

First Embodiment

A printing apparatus and a printed material manufacturing method according to a first embodiment will be explained in detail below with reference to the drawings. In the first embodiment, to prevent dispersion of ink pigments and aggregate the pigments immediately after ink droplets have dropped on a treatment object (also referred to as a recording medium or a printing medium), the surface of the treatment object is acidified. Plasma treatment will be described below as an example of an acidification method.

Furthermore, in the first embodiment, wettability of a surface of the treatment object subjected to the plasma treatment, or cohesiveness or permeability of the ink pigments based on a reduction of a pH value is controlled in order to improve the circularity of an ink dot (hereinafter, simply referred to as "a dot") and to prevent coalescence of the dots so as to enhance sharpness of the dots or a color gamut. Therefore, it becomes possible to solve an image failure, such as beading or bleed, and obtain a printed material on which a high-quality image is formed. Moreover, by reducing and equalizing the thicknesses of the aggregated pigments on the treatment object, it becomes possible to reduce the size of an ink droplet, enabling to reduce ink drying energy and printing costs.

Figure 1:
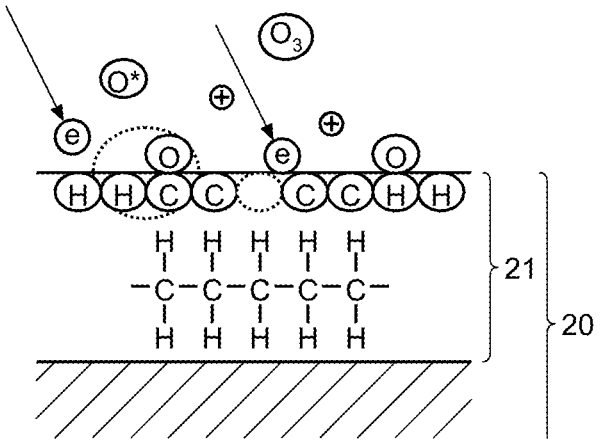
FIG. 1 is a diagram for explaining an example of plasma treatment according to a first embodiment of the present invention.

In the plasma treatment as an acidification treatment means (process), a treatment object is exposed to plasma in the atmosphere to cause polymers on the surface of the treatment object to react, so that functional groups are formed. Specifically, as illustrated in FIG. 1, electrons emitted by a discharge electrode are accelerated in an electric field and cause excitation and ionization of atoms and molecules in the atmosphere. The ionized atoms and molecules also emit electrons, so that the number of high-energy electrons increases and streamer discharge (plasma) occurs. The high-energy electrons produced by the streamer discharge break the polymer bonds on the surface of a treatment object 20 (for example, a coated paper) (a coated layer 21 of the coated paper is solidified with calcium carbonate and starch serving as a binder, and the starch has a polymer structure), and are re-combined with oxygen radical O* or ozone $O_3$ in the gas phase. Therefore, polar functional groups, such as hydroxyl groups or carboxyl groups, are formed on the surface of the treatment object 20. Consequently, hydrophilicity or acidification is achieved on the surface of the treatment object 20.

To prevent color mixture between dots, which caused by wet spreading and coalescence of adjacent dots on the treatment object due to improvement of hydrophilicity, it has been found that it is important to aggregate colorants (for example, pigments or dyes) in a dot, to dry vehicles before wet spreading of the vehicles, or to cause the vehicles to penetrate into the treatment object before wet spreading of the vehicles. Therefore, in the embodiments below, to aggregate the colorants or to cause the vehicles to penetrate into the treatment object, acidification treatment for acidifying the surface of the treatment object is performed as pre-treatment of an inkjet recording process.

Figure 2:
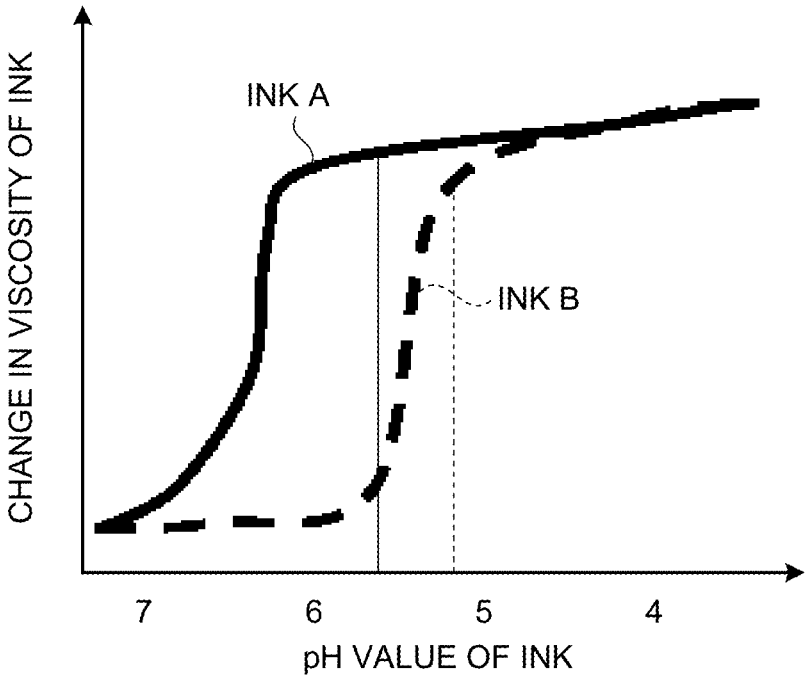
FIG. 2 is a diagram illustrating an example of a relationship between the viscosity of ink and a pH value of ink according to the first embodiment.

Furthermore, the acidification described herein means that the pH value of the surface of the printing medium is decreased to a pH value at which the pigments contained in the ink are aggregated. To decrease the pH value, the density of hydrogen ion H+ in an object is increased. FIG. 2 illustrates an example of a relationship between the pH value of the ink and the viscosity of the ink. As illustrated in FIG. 2, the viscosity of the ink increases as the pH value decreases. This is because the pigments that are negatively charged in the vehicles of the ink are more and more electrically neutralized with an increase in the acidity of the ink, and therefore, the pigments are loosely aggregated. Therefore, for example, by decreasing the pH value of the surface of the printing medium so that the pH value of the ink reaches a value corresponding to the necessary viscosity in the graph illustrated in FIG. 2, the viscosity of the ink can be increased. This is because when the ink adheres to the acid surface of the printing medium, the pigments are electrically neutralized with hydrogen ions H+ on the surface of the printing medium and are therefore aggregated. Consequently, it becomes possible to prevent color mixture between adjacent dots and prevent the pigments from penetrating to the deep inside (or even to the back side) of the printing medium. However, to decrease the pH value of the ink to the pH value corresponding to the necessary viscosity, it is necessary to set the pH value of the surface of the printing medium to a value lower than the pH value of the ink corresponding to the necessary viscosity.

Furthermore, the pH value needed to obtain the necessary viscosity of the ink differs depending on the property of the ink. Specifically, in some inks like an ink A illustrated in FIG. 2, pigments are aggregated and the viscosity increases at a pH value relatively close to the neutrality, while in other inks like an ink B as illustrated in FIG. 2, a pH value lower than the pH value of the ink A is needed to aggregate pigments.

Behavior of aggregation of the colorants in a dot, the drying rate of the vehicles, and the penetration rate of the vehicles into the treatment object vary depending on the size of a droplet that changes with the size of a dot (a small droplet, a middle droplet, or a large droplet) or depending on the type of the treatment object. Therefore, in the embodiments below, it may be possible to set plasma energy for the plasma treatment to an optimal value according to the type of the treatment object or a print mode (the size of a droplet).

A printing apparatus and a printed material manufacturing method according to the first embodiment will be explained in detail below with reference to the drawings.

In the embodiments below, an image forming apparatus including ejection heads (recording heads or ink heads) for four colors of black (K), cyan (C), magenta (M), and yellow (Y) is explained. However, the ejection heads are not limited to this example. Specifically, it may be possible to add other ejection heads for colors of green (G) and red (R) or other colors, or it may be possible to provide only an ejection head for black (K). In the description below, K, C, M, and Y represent black, cyan, magenta, and yellow, respectively.

Furthermore, in the embodiments below, a continuous roll sheet (hereinafter, referred to as "a roll sheet") is used as a treatment object; however, the present invention is not limited thereto. It may be possible to employ any recording medium, such as a cut sheet, as long as an image can be formed on the recording medium. As a type of the sheet of paper, for example, a plain paper, a high-quality paper, a recycled paper, a thin paper, a thick paper, a coated paper, or the like may be used. Furthermore, an overhead projector (OHP) sheet, a synthetic resin film, a metal thin film, or others on which an image can be formed with ink or the like may be employed as the treatment object. In the case of using paper into which ink does not penetrate or gently penetrates (e.g., a coated paper), the present invention achieves greater effectiveness. The roll sheet includes a continuous sheet (continuous stationary or continuous form paper) that is perforated at regular intervals at which the sheet can be cut off. In this case, a page of the roll sheet means an area between the perforations.

Figure 3:
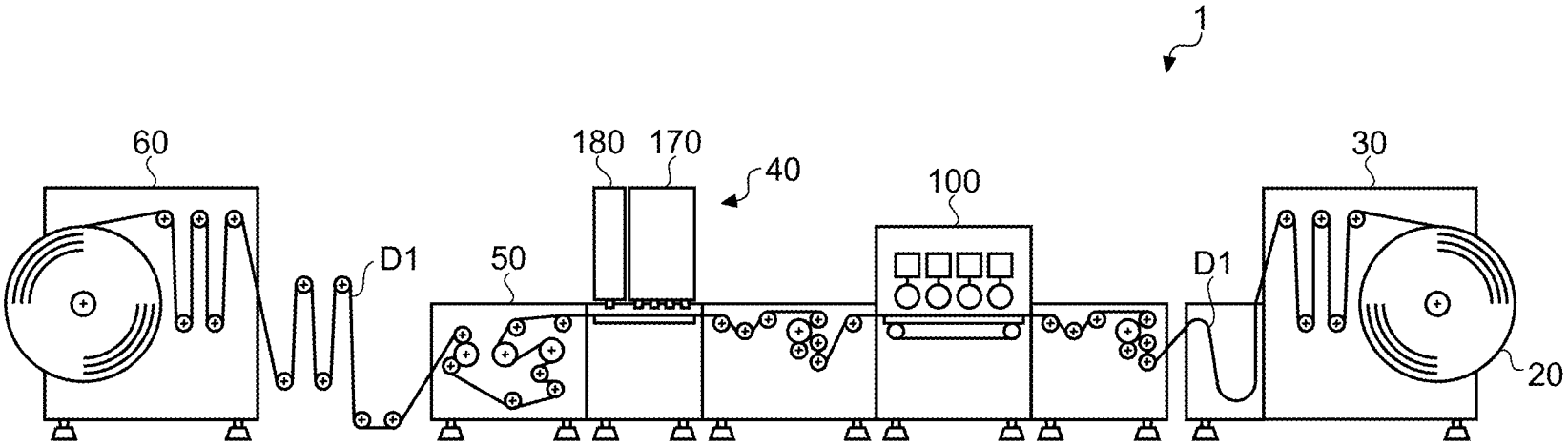
FIG. 3 is a schematic diagram illustrating an overall configuration example of a printing apparatus according to the first embodiment.

As illustrated in FIG. 3, a printing apparatus 1 includes a feed unit 30 that feeds (conveys) the treatment object 20 (roll sheet) along a conveying path D1, a plasma treatment apparatus 100 that performs plasma treatment as pre-treatment on the fed treatment object 20, and an image forming unit 40 that forms an image on the surface of the treatment object 20 subjected to the plasma treatment. The image forming unit 40 may include an inkjet head 170 for forming an image, through inkjet processing, on the treatment object 20 subjected to the plasma treatment, and a pattern reading unit 180 that reads the image formed on the treatment object 20. The image forming unit 40 may also include a post-processing unit that performs post-processing on the treatment object 20 on which the image is formed. Furthermore, the printing apparatus 1 may include a drying unit 50 that dries the treatment object 20 subjected to the post-processing, and a discharging unit 60 that discharges the treatment object 20, on which the image is formed (in some cases, on which the post-processing is also performed). Incidentally, the pattern reading unit 180 may be disposed on the downstream side of the drying unit 50 on the conveying path D1. Moreover, the printing apparatus 1 includes a control unit (not illustrated) that controls operation of each of the units.

Alternatively, the image forming unit 40 may be configured as an image forming apparatus that is separate from other units. For example, a print system may be established by the plasma treatment apparatus 100 and the image forming apparatus. The same may be applied to the following embodiments.

According to the first embodiment, in the printing apparatus 1 illustrated in FIG. 3, the acidification treatment for acidifying the treatment object is performed before the inkjet recording process as described above. For example, atmospheric pressure non-equilibrium plasma treatment using dielectric barrier discharge may be employed as the acidification treatment. The acidification treatment using the atmospheric pressure non-equilibrium plasma is one of preferable plasma treatment methods for a treatment object, such as a recording medium, because the electron temperature is extremely high and the gas temperature is close to the ordinary temperature.

To stably produce the atmospheric pressure non-equilibrium plasma over a wide range, it is preferable to perform atmospheric pressure non-equilibrium plasma treatment employing dielectric barrier discharge based on streamer electrical breakdown. The dielectric barrier discharge based on the streamer electrical breakdown can be achieved by applying an alternate high-voltage between electrodes coated with a dielectric body.

Incidentally, various methods other than the above-described dielectric barrier discharge based on the streamer electrical breakdown may be employed as the method to produce the atmospheric pressure non-equilibrium plasma. For example, it may be possible to employ dielectric barrier discharge that occurs by inserting an insulator, such as a dielectric body, between the electrodes, corona discharge that occurs due to a highly non-uniform electric field generated on a thin metal wire or the like, or pulse discharge that occurs by applying a short pulse voltage. Furthermore, two or more of the above methods may be combined.

Figure 4:
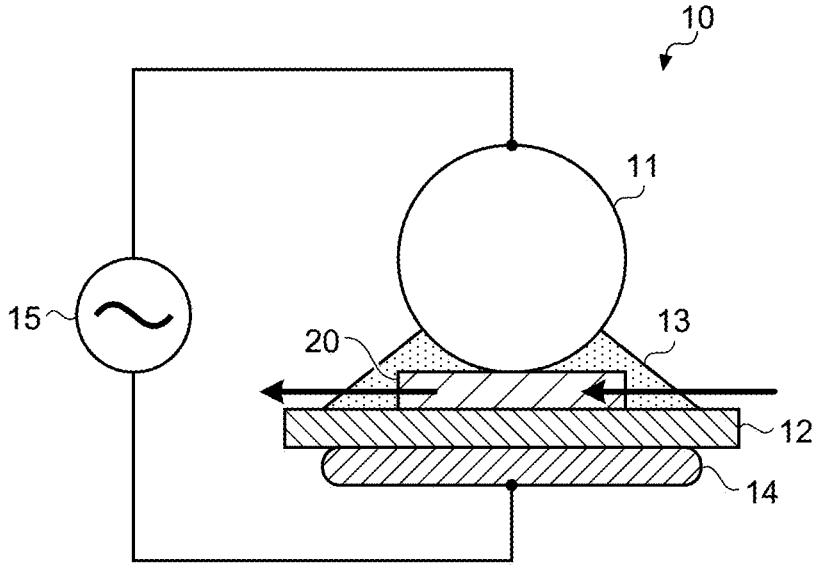
FIG. 4 is a schematic diagram for explaining overview of acidification treatment employed in the first embodiment.

FIG. 4 is a schematic diagram for explaining an overview of acidification treatment employed in the first embodiment. As illustrated in FIG. 4, in the acidification treatment employed in the first embodiment, a plasma treatment apparatus 10 including a discharge electrode 11, a ground electrode 14, a dielectric body 12, and a high-frequency high-voltage power supply 15 is used. In the plasma treatment apparatus 10, the dielectric body 12 is disposed between the discharge electrode 11 and the ground electrode 14. The high-frequency high-voltage power supply 15 applies a high-frequency high-voltage pulse voltage between the discharge electrode 11 and the ground electrode 14. The value of the pulse voltage is, for example, about 10 kilovolts (kV). The frequency of the pulse voltage may be set to, for example, about 20 kilohertz (kHz). By supplying the high-frequency high-voltage pulse voltage between the two electrodes, atmospheric pressure non-equilibrium plasma 13 is produced between the discharge electrode 11 and the dielectric body 12. The treatment object 20 passes between the discharge electrode 11 and the dielectric body 12 while the atmospheric pressure non-equilibrium plasma 13 is being produced. Therefore, the surface of the treatment object 20 on the discharge electrode 11 side is subjected to the plasma treatment.

In the plasma treatment apparatus 10 illustrated in FIG. 4, the rotary discharge electrode 11 and the belt-conveyor type dielectric body 12 are employed. The treatment object 20 is conveyed while being nipped between the discharge electrode 11 being rotated and the dielectric body 12, and passes through a space with the atmospheric pressure non-equilibrium plasma 13. Therefore, the surface of the treatment object 20 comes in contact with the atmospheric pressure non-equilibrium plasma 13 and is uniformly subjected to the plasma treatment.

Figure 5:
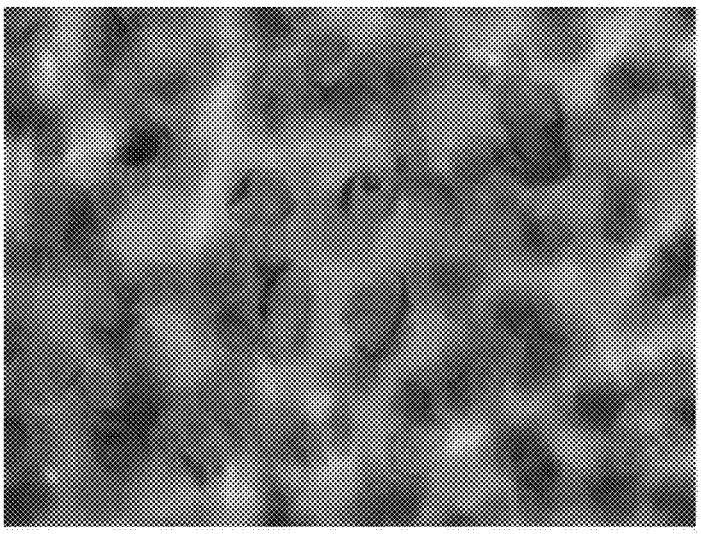
FIG. 5 is an enlarged view of a captured image of an image formation surface of a printed material that is obtained by performing an inkjet recording process on a treatment object that is not subjected to plasma treatment according to the first embodiment.
Figure 6:
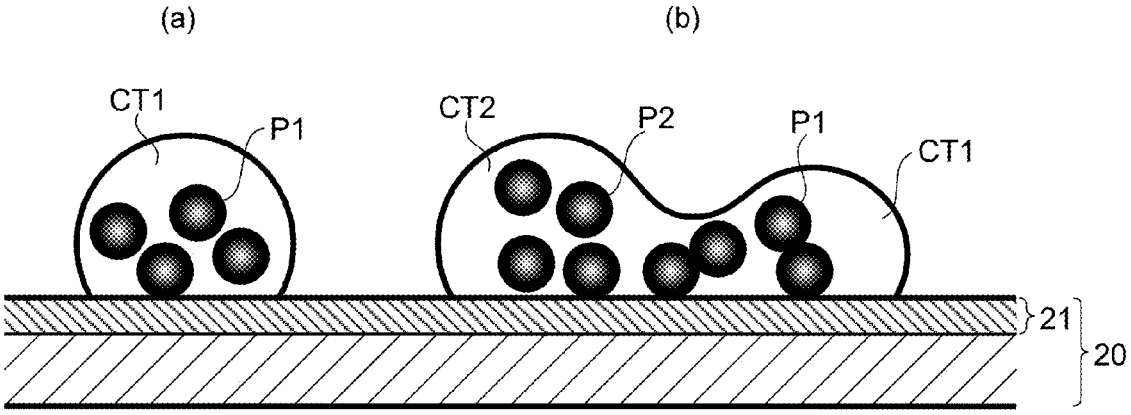
FIG. 6 is a schematic diagram illustrating an example of dots formed on the image formation surface of the printed material illustrated in FIG. 4.
Figure 7:
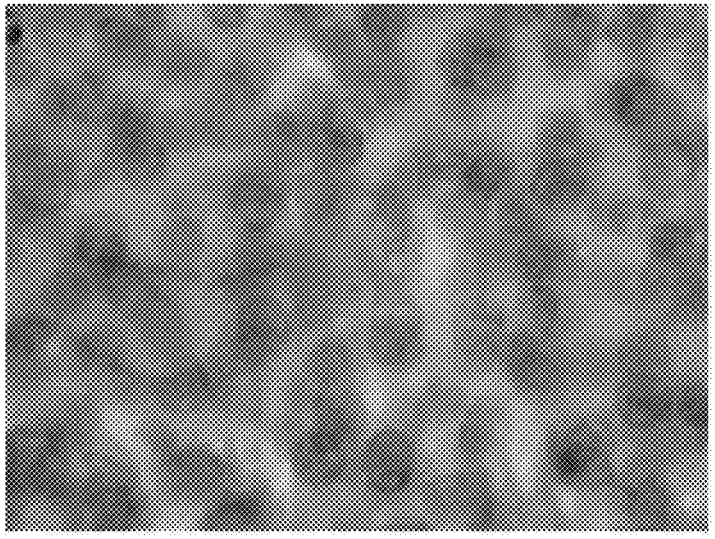
FIG. 7 is an enlarged view of a captured image of an image formation surface of a printed material that is obtained by performing an inkjet recording process on a treatment object subjected to the plasma treatment according to the first embodiment.
Figure 8:
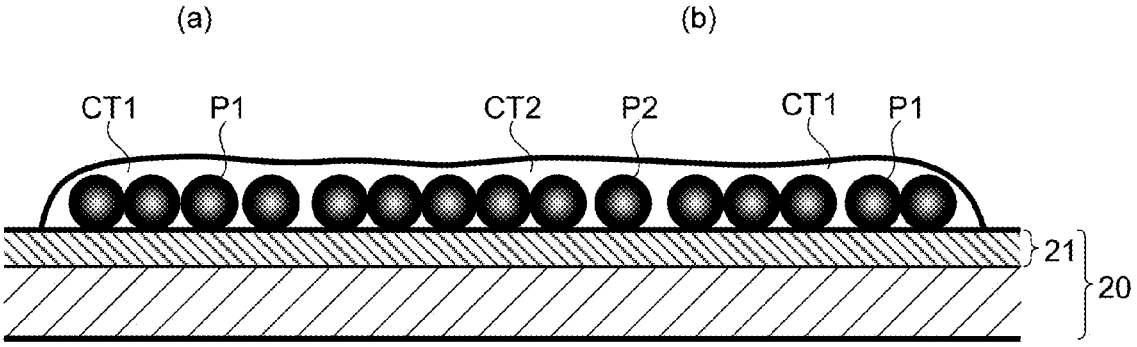
FIG. 8 is a schematic diagram illustrating an example of dots formed on the image formation surface of the printed material illustrated in FIG. 6.

A difference between a printed material obtained when to the plasma treatment according to the first embodiment is performed and a printed material obtained when the plasma treatment is not performed will be explained below with reference to FIG. 5 to FIG. 8. FIG. 5 is an enlarged view of a captured image of an image formation surface of a printed material that is obtained by performing the inkjet recording process on a treatment object that is not subjected to the plasma treatment according to the first embodiment. FIG. 6 is a schematic diagram illustrating an example of dots formed on the image formation surface of the printed material illustrated in FIG. 5. FIG. 7 is an enlarged view of a captured image of an image formation surface of a printed material that is obtained by performing the inkjet recording process on a treatment object subjected to the plasma treatment according to the first embodiment. FIG. 8 is a schematic diagram illustrating an example of dots formed on the image formation surface of the printed material illustrated in FIG. 7. A desktop type inkjet recording apparatus was used to obtain the printed materials illustrated in FIG. 5 and FIG. 7. Furthermore, a general coated paper including the coated layer 21 (see FIG. 1) was used as the treatment object 20.

If the coated paper is not subjected to the plasma treatment according to the first embodiment, the wettability of the coated layer 21 on the surface of the coated paper remains low. Therefore, in the image formed through the inkjet recording process on the coated paper that is not subjected to the plasma treatment, as illustrated in FIG. 5 and section (a) in FIG. 6, the shape of a dot (the shape of a vehicle CT1) attached to the surface of the coated paper upon landing of the dot is distorted. Furthermore, if the wettability of the surface is low, the height of the dot tends to be higher due to the surface tension of the vehicle CT1, so that a relatively long time is needed to dry the dot. If an adjacent dot is formed while the dot is not fully dried, as illustrated in FIG. 5 and section (b) in FIG. 6, the vehicle CT1 and a vehicle CT2 coalesce together when the adjacent dot lands on the coated paper, so that the pigments P1 and pigments P2 move between the dots (color mixture). As a result, density unevenness due to beading or the like may occur.

In contrast, if the coated paper is subjected to the plasma treatment according to the first embodiment, the wettability of the coated layer 21 on the surface of the coated paper is improved. Therefore, in the image formed through the inkjet recording process on the coated paper subjected to the plasma treatment, as illustrated in FIG. 7 for example, the vehicle CT1 spreads in a relatively-flat exact circular shape on the surface of the coated paper. Therefore, as illustrated in FIG. 8, the dot is flatten in shape. Furthermore, the surface of the coated paper is acidified due to the polar functional groups generated through the plasma treatment and then electrically neutralized with the ink pigments, so that the pigments P1 are aggregated and the viscosity of the ink increases. With this, as illustrated in FIG. 8, even when the vehicles CT1 and CT2 coalesce together, it is possible to prevent the pigments P1 and P2 from moving between the dots (color mixture). Moreover, the polar functional groups are also generated inside the coated layer 21, so that the permeability of the vehicle CT1 increases. The dots each spreading in an exact circular sphere due to improvement in wettablility are aggretaged while penetrating into the treatment object, and therefore, the pigments P1 are uniformly aggregated in height direction. This makes it possible to prevent occurrence of density unevenness due to the beading or the like. It is noted that FIGS. 6 and 8 are schematic diagrams, and in a case illustrated in FIG. 8, the pigments are aggregated in a layer in practice.

As described above, the surface of the treatment object 20 subjected to the plasma treatment according to the first embodiment is acidified due to the polar functional groups generated through the plasma treatment. Therefore, the negatively-charged pigments are neutralized on the surface of the treatment object 20, so that the pigments are aggregated and the viscosity increases. As a result, it becomes possible to prevent movement of the pigments even when the dots coalesce together. Furthermore, the polar functional groups are also generated inside the coated layer 21 formed on the surface of the treatment object 20, so that the vehicle can quickly penetrate to the inside of the treatment object 20. Therefore, the drying time can be reduced. In other words, the dot, which spread in an exact circular shape due to improvement in wettablitity, is penetrated in a state that movement of the pigments is prevented because of the aggregation effect, and therefore, an approximately exact circular shape can be maintained.

Figure 9:
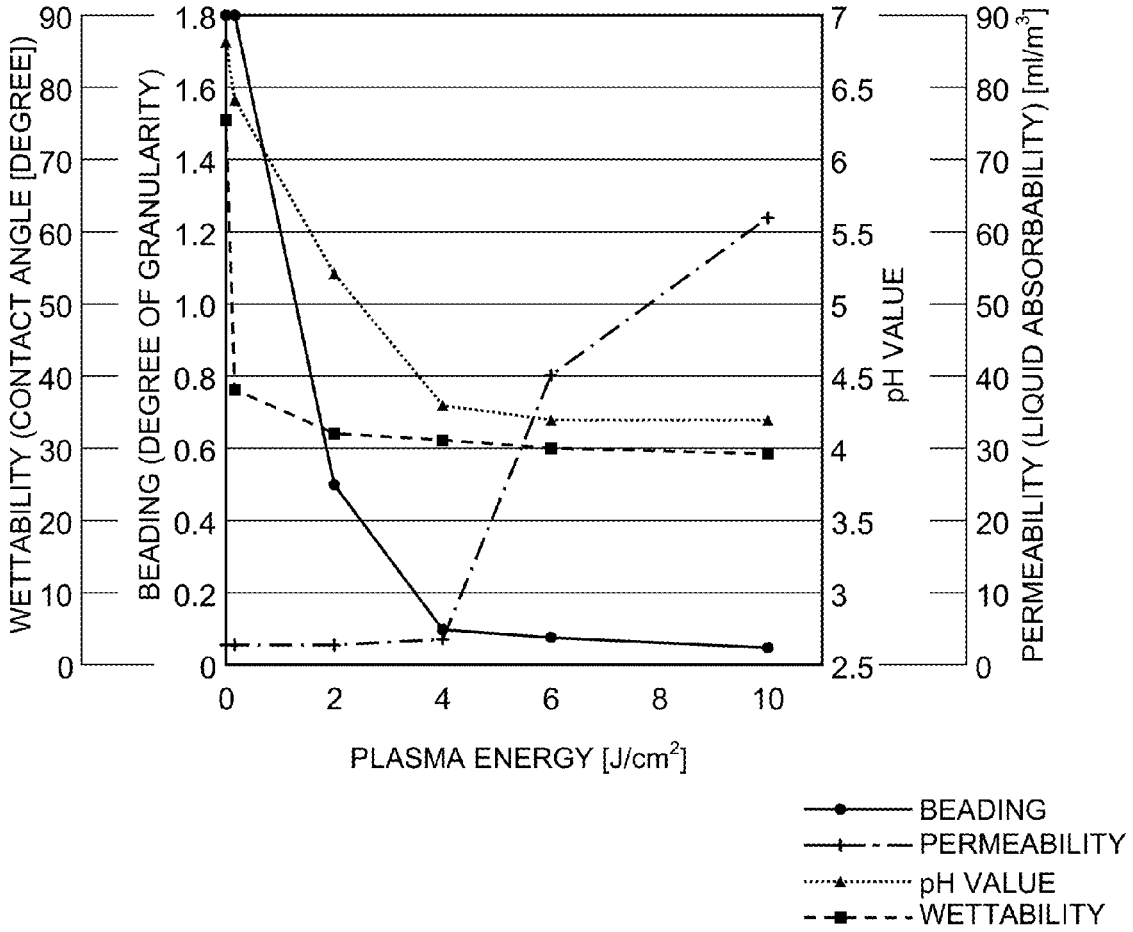
FIG. 9 is a graph showing relationships of wettability, beading, a pH value, and permeability with respect to plasma energy according to the first embodiment.

FIG. 9 is a graph showing relationships of the wettability, the beading, the pH value, and the permeability of the surface of a treatment object with respect to the plasma energy according to the first embodiment. FIG. 9 illustrates how the surface properties (the wettability, the beading, the pH value, and the permeability (the liquid absorbability)) change depending on the plasma energy when printing is performed on a coated paper serving as the treatment object 20. To obtain the evaluation illustrated in FIG. 9, aqueous pigment ink, in which pigments are aggregated with the aid of acid (alkaline ink in which negatively-charged pigments are dispersed), is used as the ink.

As illustrated in FIG. 9, the wettability of the surface of the coated paper is greatly improved when the value of the plasma energy is low (for example, about 0.2 J/cm$^2$ or lower), but is not further improved even if the energy is increased. In contrast, the pH value of the surface of the coated paper decreases to a certain extent with an increase in the plasma energy. However, saturation occurs when the plasma energy exceeds a certain value (for example, about 4 J/cm$^2$). The permeability (the liquid absorbability) is greatly improved when a decrease in the pH reaches a saturation point (for example, about 4 J/cm$^2$). However, the phenomenon varies depending on a polymer component contained in the ink.

As a result, the value of the beading (degree of granularity) is maintained in an excellent condition after the permeability (liquid absorbability) begins to improve (for example, after about 4 J/cm$^2$). The beading (degree of granularity) in this example represents the degree of roughness of the image by values, in particular, represents the density unevenness by standard deviation of an average density. In FIG. 9, multiple densities are sampled from a color solid image formed of dots of two or more colors, and the standard deviation of the densities is represented as the beading (degree of granularity). In this manner, the ink ejected on the coated paper subjected to the plasma treatment according to the first embodiment spreads in an exact circular shape and penetrates into the coated paper while being aggregated. Therefore, the beading (degree of granularity) can be improved.

As described above, in the relationship between the property of the surface of the treatment object 20 and the image quality, the dot circularity improves as the wettability of the surface improves. This is because the wettability of the surface of the treatment object 20 is improved and uniformed due to the hydrophilic polar functional groups generated through the plasma treatment, and components, such as contaminants, oil, or calcium carbonate, which cause water repellency, are removed through the plasma treatment. Due to the improvement of the wettability of the surface of the treatment object 20, the droplets are evenly spread in the circumferential direction, resulting in the improved dot circularity.

Furthermore, by acidifying the surface of the treatment object 20 (by reducing the pH), the ink pigments are aggregated, the permeability is improved, and the vehicle penetrates to the inside of the coated layer. Therefore, pigment density on the surface of the treatment object 20 increases, so that even if the dots coalesce together, it is possible to prevent movement of the pigments. As a result, it becomes possible to prevent mixture of the pigments and cause the pigments to be evenly deposited and aggregated on the surface of the treatment object. However, an inhibiting effect on pigment mixture varies depending on the components of the ink or the size of the ink droplet. For example, if the size of the ink droplet is small (small droplet), the pigments are less likely to be mixed due to the coalescence of the dots compared with a case that the size of the ink droplet is large (large droplet). This is because, if the size of a vehicle is small (small droplet), the vehicle can be dried and penetrated more quickly, and the pigments can be aggregated at a low pH reaction. Meanwhile, the effect of the plasma treatment varies depending on the type of the treatment object 20 or an environment (humidity or the like). Therefore, by setting the plasma energy for the plasma treatment to an optimal value, the surface modification efficiency of the treatment object 20 can be improved, so that further energy saving can be achieved.

Figure 10:
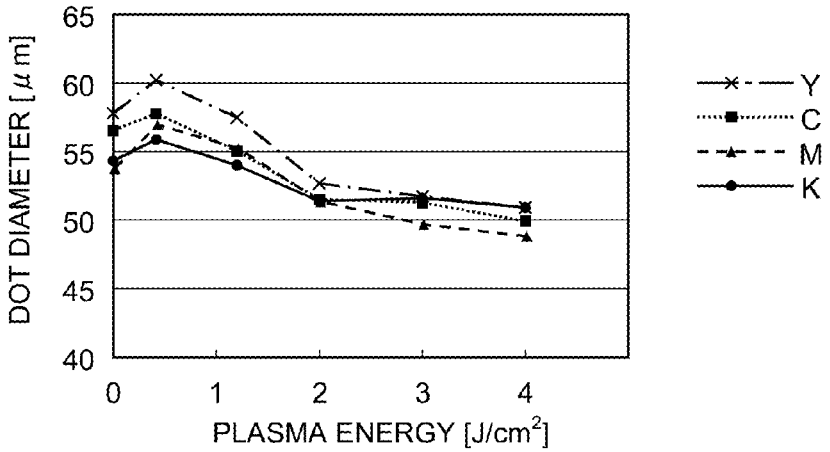
FIG. 10 is a graph showing a relationship between the plasma energy and a dot diameter.
Figure 11:
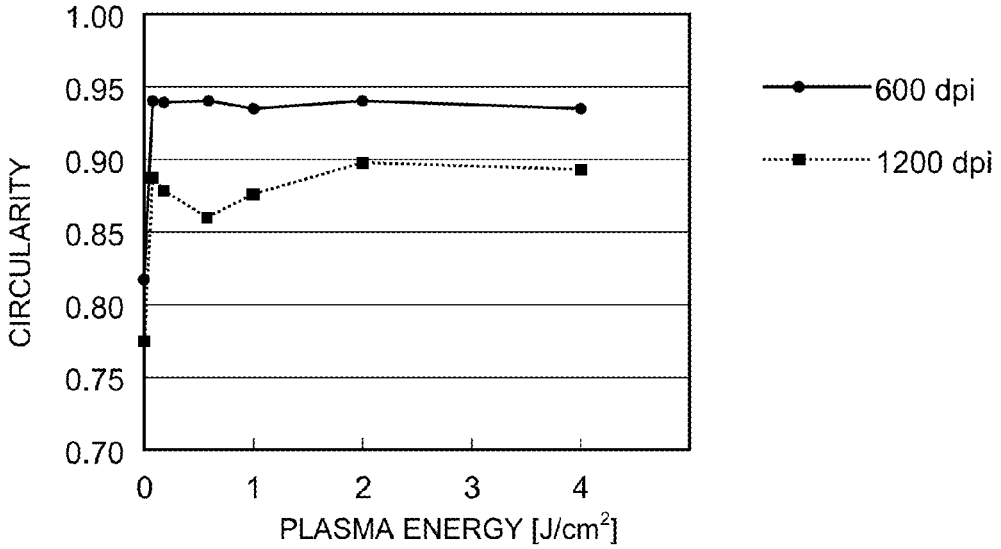
FIG. 11 is a graph showing a relationship between the plasma energy and dot circularity.
Figure 12:
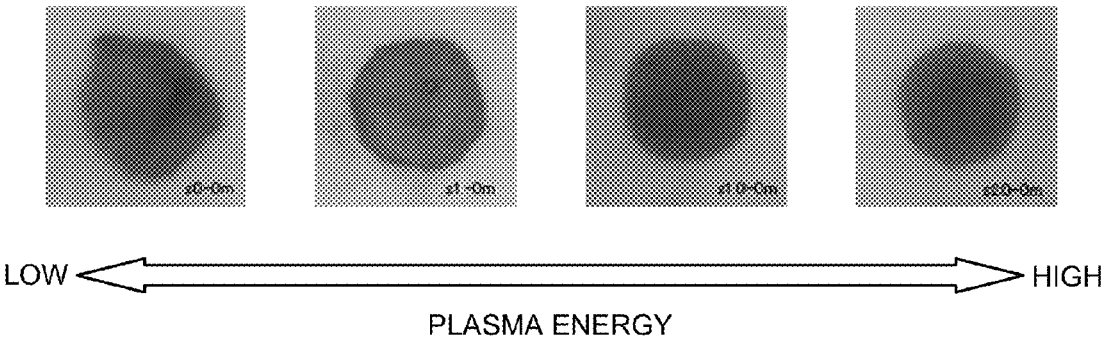
FIG. 12 is a diagram illustrating a relationship between the plasma energy and a shape of an actually-formed dot.

A relationship between the plasma energy and the dot circularity will be explained below. FIG. 10 is a graph showing a relationship between the plasma energy and a dot diameter. FIG. 11 is a graph showing a relationship between the plasma energy and the dot circularity. FIG. 12 is a diagram illustrating a relationship between the plasma energy and a shape of an actually-formed dot.

As illustrated in FIG. 10, if the plasma energy is increased, the dot diameters of all of CMYK pigments tend to decrease. The reason for this is that a pigment aggregation effect (an increase in the viscosity due to the aggregation) and a permeability effect (penetration of the vehicles into the coated layer) are improved because of the plasma treatment, and therefore, the dots are quickly aggregated and penetrated while spreading. By using the effects as described above, it becomes possible to control the dot diameter. Namely, it becomes possible to control the dot diameter by controlling the plasma energy.

Furthermore, as illustrated in FIG. 11 and FIG. 12, the dot circularity is greatly improved even at a low plasma energy value (for example, about 0.2 J/cm$^2$ or lower). The reason for this is that, as described above, the viscosity of the dot (vehicle) and the permeability of the vehicle are improved by performing the plasma treatment on the treatment object 20, and accordingly, the pigments are evenly aggregated.

Figure 13:
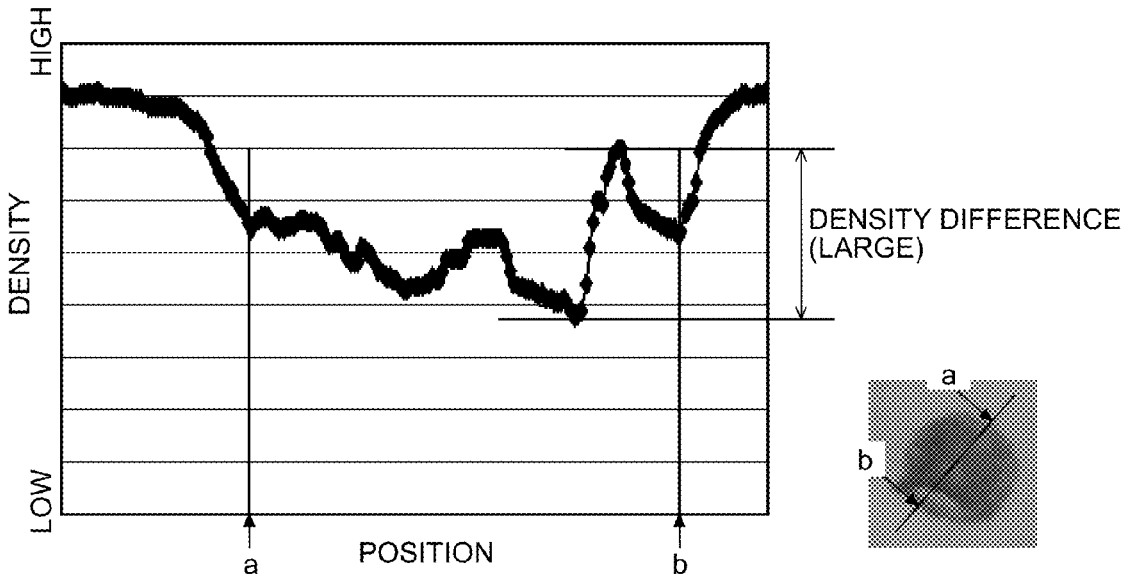
FIG. 13 is a graph showing pigment density in a dot when the plasma treatment according to the first embodiment is not performed.
Figure 14:
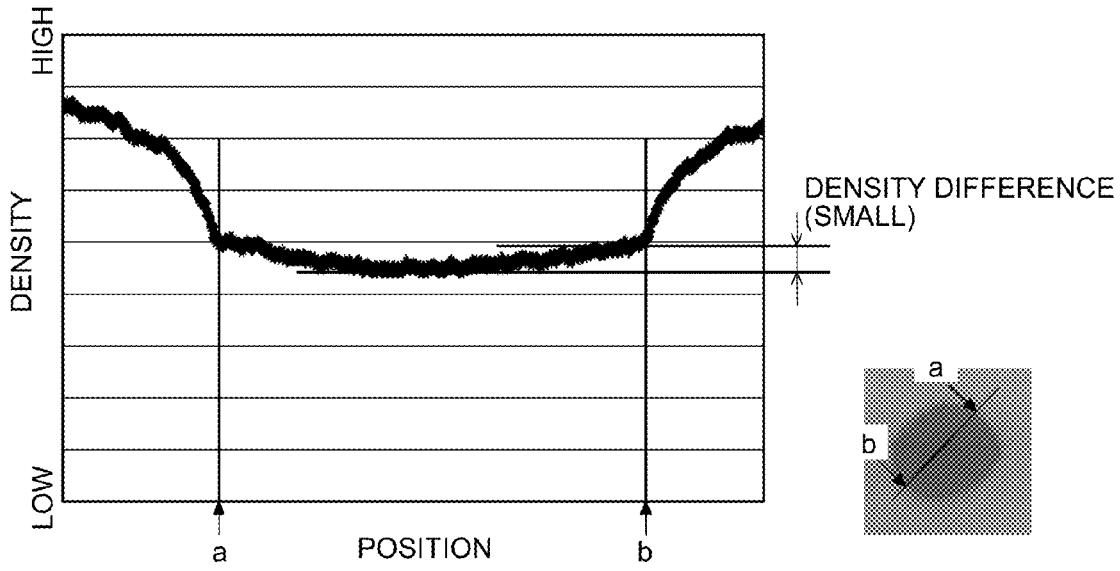
FIG. 14 is a graph showing pigment density in a dot when the plasma treatment according to the first embodiment is performed.

Next, the pigment density in a dot obtained when the plasma treatment is performed and the pigment density in a dot obtained when the plasma treatment is not performed will be explained. FIG. 13 is a graph showing the pigment density of a dot when the plasma treatment according to the first embodiment is not performed. FIG. 14 is a graph showing the pigment density of a dot when the plasma treatment according to the first embodiment is performed. FIG. 13 and FIG. 14 illustrate the density on a segment a-b in a dot image illustrated in the lower right corner on each of the drawings.

In the measurement illustrated in FIG. 13 and FIG. 14, an image of a formed dot was acquired, density unevenness in the image was measured, and a variation in the density was calculated. As is evident from comparison of FIG. 13 and FIG. 14, a variation in the density (density difference) can be more reduced when the plasma treatment is performed (FIG. 14) than when the plasma treatment is not performed (FIG. 13). Therefore, it may be possible to optimize the plasma energy in the plasma treatment so that the variation (density difference) can be minimized based on the variation in the density calculated through the calculation method as described above. Consequently, it becomes possible to form a clearer image.

The method to calculate the variation in the density is not limited to the above, and the variation may be calculated by measuring a thickness of the pigment by an optical interference film thickness measuring means. In this case, it may be possible to select an optimal value of the plasma energy so that a deviation of the thickness of the pigment can be minimized.

Figure 15:
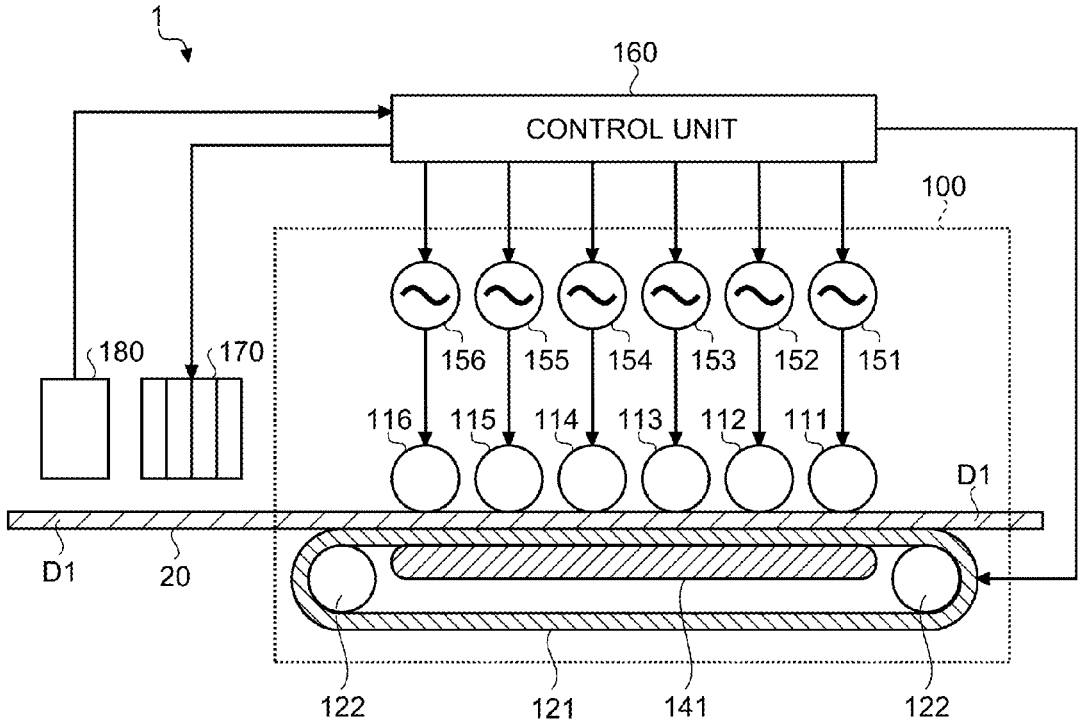
FIG. 15 is a schematic diagram illustrating a detailed configuration of components from a plasma treatment apparatus to a pattern reading unit arranged on the downstream side of an inkjet recording apparatus in the printing apparatus according to the first embodiment.

The printing apparatus 1 according to the first embodiment will be explained in detail below. In the printing apparatus 1, a pattern reading means that acquires an image of a formed dot is provided on the downstream side of an inkjet recording means. The acquired image is analyzed to calculate the dot circularity, the dot diameter, a variation in the density, or the like, and feedback control or feedforward control is performed on a plasma treatment means based on the calculation results. FIG. 15 illustrates a detailed configuration of components from the plasma treatment apparatus to the pattern reading unit arranged on the downstream side of an inkjet recording apparatus in the printing apparatus according to the first embodiment. Other configurations are the same as the printing apparatus 1 illustrated in FIG. 3; therefore, detailed explanation thereof will be omitted.

As illustrated in FIG. 15, the printing apparatus 1 includes the plasma treatment apparatus 100 arranged on the upstream side of the conveying path D1, the inkjet head 170 arranged on the downstream side of the plasma treatment apparatus 100 in the conveying path D1, the pattern reading unit 180 arranged on the downstream side of the inkjet head 170, and a control unit 160 that controls each of the units of the plasma treatment apparatus 100. The inkjet head 170 ejects ink to form an image on the treatment object 20 whose surface has been subjected to the plasma treatment by the plasma treatment apparatus 100 arranged on the upstream side. The inkjet head 170 may be controlled by a separately-provided control unit (not illustrated) or may be controlled by the control unit 160.

The plasma treatment apparatus 100 includes a plurality of discharge electrodes 111 to 116 arranged along the conveying path D1, high-frequency high-voltage power supplies 151 to 156 that supply high-frequency high-voltage pulse voltages to the discharge electrodes 111 to 116, respectively, a ground electrode 141 shared by the discharge electrodes 111 to 116, a belt-conveyor type endless dielectric body 121 that is arranged so as to run between the discharge electrodes 111 to 116 and the ground electrode 141 along the conveying path D1, and a roller 122. If the discharge electrodes 111 to 116 arranged along the conveying path D1 are used, it is preferable to employ an endless belt as the dielectric body 121 as illustrated in FIG. 15.

The control unit 160 drives the roller 122 based on an instruction from a higher-level apparatus (not illustrated) to circulate the dielectric body 121. The treatment object 20 is fed onto the dielectric body 121 by the feed unit 30 (see FIG. 3) on the upstream side and then passes through the conveying path D1 along with the circulation of the dielectric body 121.

The high-frequency high-voltage power supplies 151 to 156 supply high-frequency high-voltage pulse voltages to the discharge electrodes 111 to 116, respectively, according to an instruction from the control unit 160. The pulse voltages may be supplied to all of the discharge electrodes 111 to 116, or may be supplied to an arbitrary number of the discharge electrodes 111 to 116 needed to decrease the pH value of the surface of the treatment object 20 to a predetermined value or lower. Alternatively, the control unit 160 may adjust the frequency and a voltage value (corresponding to plasma energy; hereinafter, referred to as "plasma energy") of the pulse voltage supplied by each of the high-frequency high-voltage power supplies 151 to 156 to plasma energy needed to decrease the pH value of the surface of the treatment object 20 to the predetermined value or lower.

The pattern reading unit 180 captures images of dots of an image formed on the treatment object 20 for example. The image formed on the treatment object 20 may be a test pattern for analyzing the dots. In the following explanation, the test pattern is used as an example.

The image acquired by the pattern reading unit 180 is input to the control unit 160. The control unit 160 analyzes the input image to calculate the dot circularity, the dot diameter, a variation in the density, or the like of the test pattern, and adjusts the number of the discharge electrodes 111 to 116 to be driven and/or the plasma energy of the pulse voltage to be supplied by each of the high-frequency high-voltage power supplies 151 to 156 to each of the discharge electrodes 111 to 116 based on the calculation result.

As one method to obtain the plasma energy needed to perform necessary and sufficient plasma treatment on the surface of the treatment object 20, it may be possible to increase the time of the plasma treatment. This can be achieved by, for example, decreasing the conveying speed of the treatment object 20. However, to record an image on the treatment object 20 at high speed, it is desirable to reduce the time of the plasma treatment. As a method to reduce the time of the plasma treatment, as described above, it may be possible to provide a plurality of the discharge electrodes 111 to 116 and drive a necessary number of the discharge electrodes 111 to 116 according to the print speed and necessary plasma energy, or to adjust the intensity of the plasma energy to be applied to each of the discharge electrodes 111 to 116. However, the method is not limited to the above, and may be changed appropriately. For example, the above methods may be combined or other methods may be applied.

As illustrated in FIG. 15, the inkjet head 170 may include a plurality of heads for the same color (4 colors×4 heads). With this configuration, the speed of the inkjet recording process can be increased. In this case, for example, to obtain the resolution of 1200 dpi at high speed, the heads of each of the colors in the inkjet head 170 are fixed so as to be deviated from one another to correct a gap between nozzles for ejecting ink. Furthermore, a drive pulse with a variety of drive frequencies is input to the heads of each of the colors so that an ink dot ejected from each of the nozzles can correspond to three different sizes of a large droplet, a medium droplet, and a small droplet.

The control unit 160 can individually turn on and off the high-frequency high-voltage power supplies 151 to 156. For example, the control unit 160 selects the number of the high-frequency high-voltage power supplies 151 to 156 to be driven in proportion to print speed information, or adjusts the intensity of the plasma energy of the pulse voltage to be applied to each of the discharge electrodes 111 to 116. Alternatively, the control unit 160 may adjust the number of the high-frequency high-voltage power supplies 151 to 156 to be driven or adjust the intensity of the plasma energy to be applied to each of the discharge electrodes 111 to 116 depending on the type of the treatment object 20 (for example, a coated paper, a polyester (PET) film, or the like).

If a plurality of the discharge electrodes 111 to 116 are provided, it is advantageous to uniformly perform the plasma treatment on the surface of the treatment object 20. Specifically, if the conveying speed (or the print speed) is the same, it is possible to increase the time to convey the treatment object 20 through a plasma space when the plasma treatment is performed with a plurality of discharge electrodes than when the plasma treatment is performed with a single discharge electrode. Therefore, it becomes possible to uniformly perform the plasma treatment on the surface of the treatment object 20.

Figure 16:
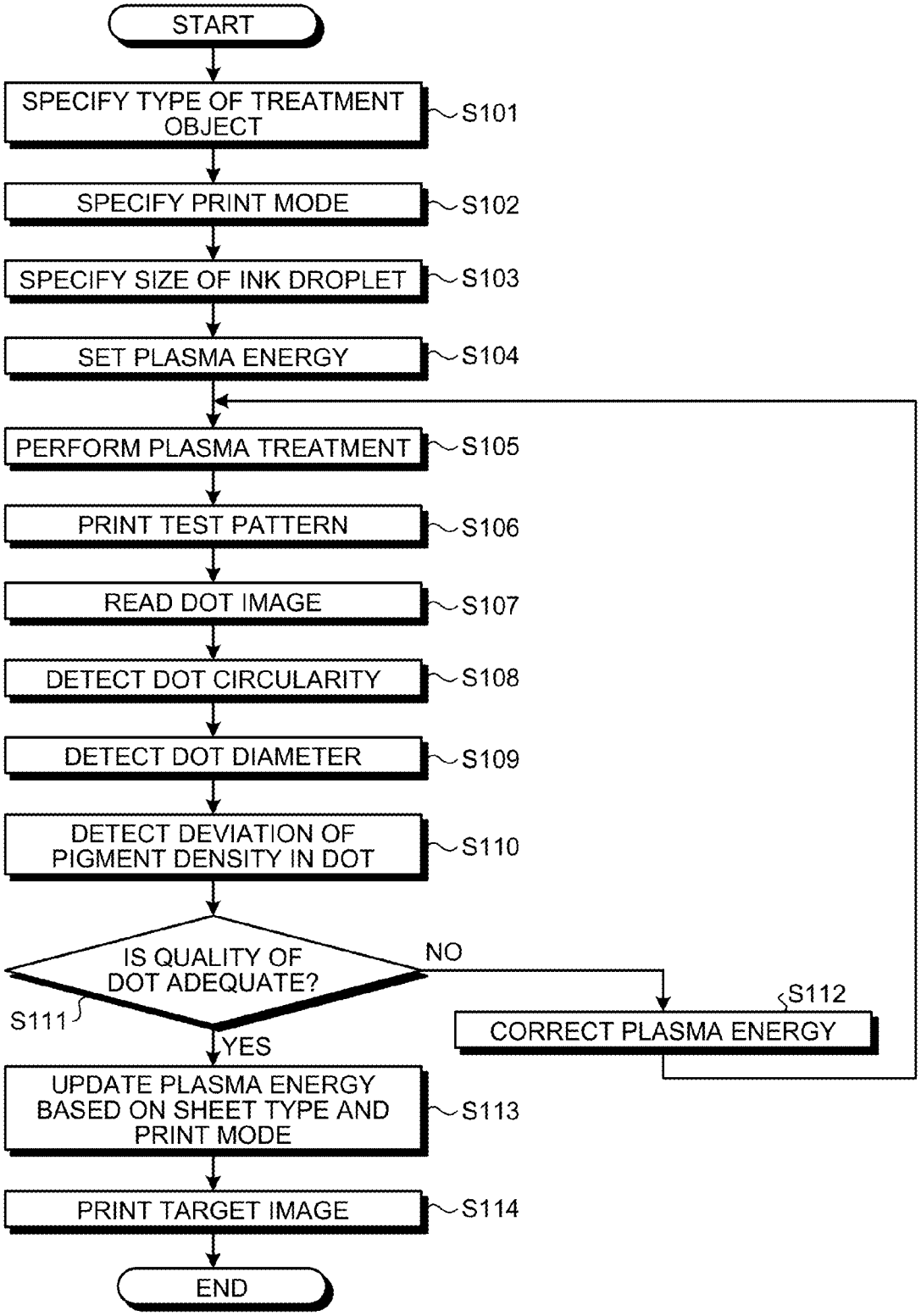
FIG. 16 is a flowchart illustrating an example of a printing process including plasma treatment according to the first embodiment.

A printing process including the plasma treatment according to the first embodiment will be explained in detail below with reference to the drawings. FIG. 16 is a flowchart illustrating an example of the printing process including the plasma treatment according to the first embodiment. FIG. 17 is a diagram illustrating an example of a table used to specify the size of an ink droplet and the plasma energy in the flowchart illustrated in FIG. 16. In FIG. 16, an example is illustrated in which the printing apparatus 1 illustrated in FIG. 15 performs printing by using a cut sheet (a recording medium that is cut in a predetermined size) as the treatment object 20. The same printing process can be applied to a roll sheet that is rolled up, instead of the cut sheet.

As illustrated in FIG. 16, in the printing process, the control unit 160 specifies a type of the treatment object 20 (sheet type) (Step S101). The type of the treatment object 20 (sheet type) may be set and input to the printing apparatus 1 by a user through a control panel (not illustrated). Alternatively, the printing apparatus 1 may include a sheet type detecting means (not illustrated), and the control unit 160 may specify the sheet type based on sheet type information detected by the sheet type detecting means. For example, the sheet type detecting means may apply laser light to the surface of a sheet and analyze interference spectrum of the reflected light to specify the sheet type. The control unit 160 also specifies a print mode (Step S102). For example, the print mode may be the resolution (600 dpi, 1200 dpi, or the like) of an image of a printed material, and may be set by the user using an input unit (not illustrated). Furthermore, the print mode may include monochrome printing or color printing.

Subsequently, the control unit 160 specifies the size of an ink droplet for image formation (Step S103). The size of the ink droplet may be specified from a table as illustrated in FIG. 17 based on, for example, the print mode and the dot size specified as described above. For example, if the print mode is 1200 dpi and the dot size is a small droplet, the size of the ink droplet can be specified as 2 picoliters (pl) based on the table illustrated in FIG. 17. For another example, if the print mode is 600 dpi and the dot size is a large droplet, the size of the ink droplet can be specified as 15 pl. Meanwhile, the dot size is the size of a droplet ejected by the inkjet head 170 or the size of a dot formed on the treatment object 20, and may be specified by the control unit 160 based on image information on a printing object.

Subsequently, the control unit 160 sets plasma energy for the plasma treatment (Step S104). The plasma energy can be specified from the table as illustrated in FIG. 17 based on the type (sheet type) of the treatment object 20 and the size of the ink droplet specified as described above. For example, if the type of the treatment object 20 is a coated paper A and the size of the ink droplet is 6 pl, the control unit 160 sets the plasma energy to 0.7 J/cm$^2$. While a value of the plasma energy is registered in the table illustrated in FIG. 17, the embodiment is not limited to this example. For example, it may be possible to register a voltage value and a pulse duration of the pulse voltage to be supplied by the high-frequency high-voltage power supplies 151 to 156 to the discharge electrodes 111 to 116. Furthermore, it may be possible to register, in the table illustrated in FIG. 17, different plasma energy depending on the monochrome print mode and the color print mode. Moreover, the table illustrated in FIG. 17 may be divided into a part used at Step S103 and a part used at Step S104.

Subsequently, the control unit 160 appropriately supplies the pulse voltage from the high-frequency high-voltage power supplies 151 to 156 to the discharge electrodes 111 to 116 based on the set plasma energy, to thereby perform the plasma treatment on the treatment object 20 (Step S105). The control unit 160 then prints a test pattern on the treatment object 20 subjected to the plasma treatment (Step S106). The control unit 160 captures an image of a dot of the test pattern by using the pattern reading unit 180 and reads the image of the dot (dot image) formed on the treatment object 20 subjected to the plasma treatment (Step S107).

The control unit 160 detects the dot circularity (Step S108), the dot diameter (Step S109), a deviation of the pigment density in the dot (a variation or density difference) (Step S110) from the read dot image. Alternatively, the control unit 160 may determine the coalescence state of dots from the read dot image. The coalescence state of the dots can be determined by, for example, pattern recognition.

The control unit 160 determines whether the quality of the formed dot is adequate based on the dot circularity, the dot diameter, and the deviation of the pigment density in the dot, (or also based on the coalescence state of the dots) that are detected as described above (Step S111). If the quality is not adequate (NO at Step S111), the control unit 160 corrects the plasma energy according to the dot circularity, the dot diameter, and the deviation of the pigment density in the dot (or also according to the coalescence state of the dots) that are detected as described above (Step S112), and returns the process to Step S105 to analyze the dot from the printed test pattern. The correction may be performed by increasing or decreasing the set plasma energy based on a correction value of a predetermined amount set in advance. Alternatively, the correction may be performed by calculating optimal plasma energy according to the dot circularity, the dot diameter, and the deviation of the pigment density in the dot (or also according to the coalescence state of the dots) that are detected as described above, and re-setting the plasma energy to the optimal value.

In contrast, if the quality of the dot is adequate (YES at Step S111), the control unit 160 updates the plasma energy registered in the table in FIG. 17 based on the type of the treatment object 20 (the sheet type) and the print mode specified as described above (Step S113), prints an image that is an actual printing object (Step S114), and ends the process upon completion of the printing.

Incidentally, if a roll sheet is used as the treatment object 20, it may be possible to acquire, at Step S105 to S112, a dot image that is formed on a leading end portion of a sheet guided by a sheet feed device (not illustrated) after the plasma treatment. If the roll sheet is used, because the property of the same roll remains almost unchanged, it becomes possible to stably perform continuous printing with the same setting after the plasma energy is adjusted by using the leading end portion. However, if the use of the roll sheet is suspended for a long time before the roll sheet is used up, the property of the sheet may change. Therefore, before the printing is resumed, it is preferable to acquire and analyze a dot image that is formed on the leading end portion subjected to the plasma treatment in the same manner as described above. Alternatively, after the dot image that is formed on the leading end portion after the plasma treatment is analyzed and then the plasma energy is adjusted, it may be possible to periodically or continuously measure the dot image and adjust the plasma energy. With this configuration, it becomes possible to more precisely and stably perform the control.

Furthermore, while the table as illustrated in FIG. 17 is used in the process in FIG. 16, the embodiment is not limited to this method. For example, it may be possible to set the initial plasma energy as a minimum value, and gradually increase the plasma energy based on an analysis result of a dot image of an obtained test pattern.

Figure 18:
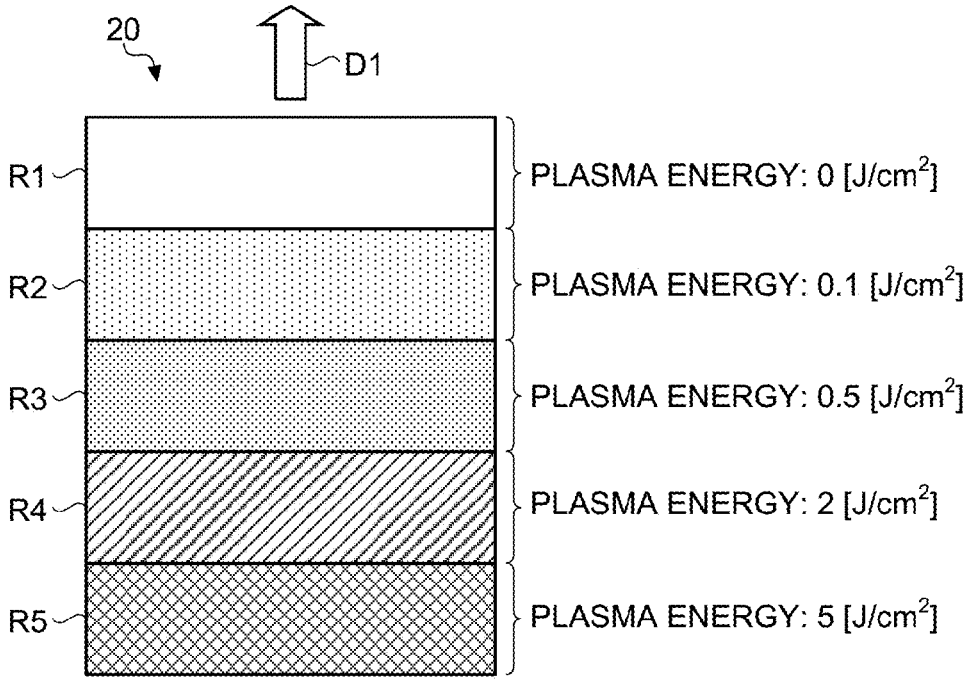
FIG. 18 is a diagram illustrating an example of a treatment object subjected to the plasma treatment at Step S105 in FIG. 16.

If the plasma energy is gradually increased from the minimum value, it may be possible to change the plasma energy to be applied to each of the discharge electrodes 111 to 116 in FIG. 15 such that the plasma energy gradually increases from the downstream side, or it may be possible to change the conveying speed of the treatment object 20, that is, the circulation speed of the dielectric body 121. As a result, at Step S105 in FIG. 16, as illustrated in FIG. 18, it becomes possible to obtain the treatment object 20 in which each of regions is subjected to the plasma treatment with different plasma energy. In FIG. 18, a region R1 is not subjected to the plasma treatment (the plasma energy=0 J/cm$^2$), a region R2 is subjected to the plasma treatment with the plasma energy of 0.1 J/cm$^2$, a region R3 is subjected to the plasma treatment with the plasma energy of 0.5 J/cm$^2$, a region R4 is subjected to the plasma treatment with the plasma energy of 2 J/cm$^2$, and a region R5 is subjected to the plasma treatment with the plasma energy of 5 J/cm$^2$.

Figure 19:
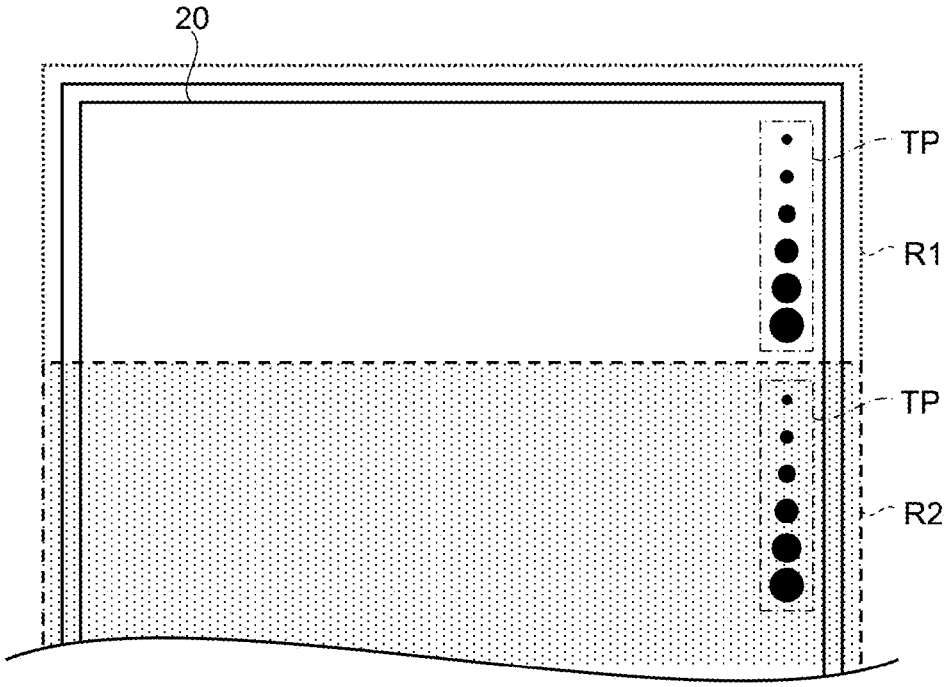
FIG. 19 is a diagram illustrating an example of a test pattern formed at Step S106 in FIG. 16.
Figure 20:
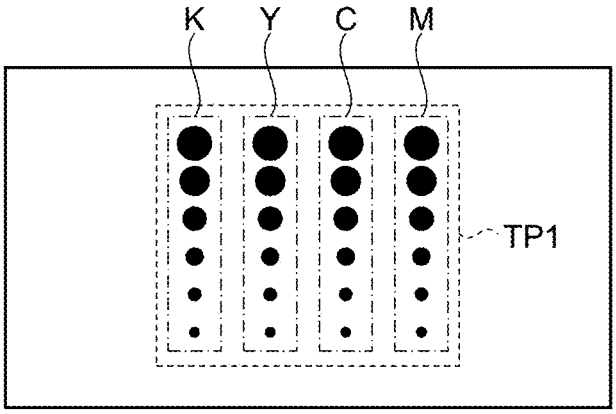
FIG. 20 is a diagram illustrating another example of the test pattern.

Furthermore, for the treatment object 20 in which each of the regions is subjected to the plasma treatment with different plasma energy as illustrated in FIG. 18, for example, it may be possible to form a common test pattern TP containing a plurality of dots with different dot diameters as illustrated in FIG. 19 in each of the regions R1 to R5 at Step S106 in FIG. 16. Alternatively, the test pattern illustrated in FIG. 19 may be replaced with a test pattern containing a plurality of dots with different dot diameters for each of CMYK as illustrated in FIG. 20.

Figure 21:
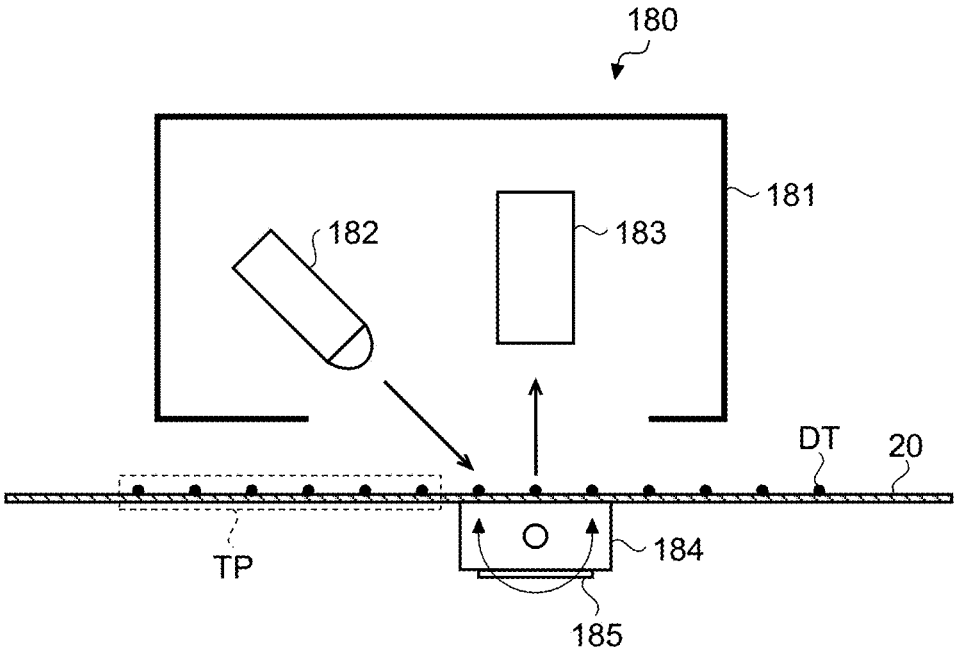
FIG. 21 is a schematic diagram illustrating an example of the pattern reading unit according to the first embodiment.

The test pattern TP formed as described above is read by the pattern reading unit 180 illustrated in FIG. 15 at Step S107 in FIG. 16. FIG. 21 illustrates an example of the pattern reading unit 180 according to the first embodiment.

As illustrated in FIG. 21, for example, a reflective two-dimensional sensor including a light-emitting unit 182 and a light-receiving unit 183 is used as the pattern reading unit 180. For example, the light-emitting unit 182 and the light-receiving unit 183 are arranged in a case 181 that is disposed on a dot formation side with respect to the treatment object 20. An opening is arranged on the treatment object 20 side of the case 181, and light emitted by the light-emitting unit 182 is reflected from the surface of the treatment object 20 and incident on the light-receiving unit 183. The light receiving unit 183 focuses the amount of the reflected light (the intensity of the reflected light) reflected from the surface of the treatment object 20. The focused amount (intensity) of the reflected light varies between a portion with a printed image (a dot DT of the test pattern TP) and a portion without the printed image. Therefore, it is possible to detect the dot shape and the image density in the dot based on the amount of the reflected light (the intensity of the reflected light) detected by the light-receiving unit 183. Incidentally, the configuration and the detection method of the pattern reading unit 180 may be changed in various forms as long as the test pattern TP printed on the treatment object 20 is detectable.

Furthermore, the pattern reading unit 180 may include a reference pattern display unit 184 including a reference pattern 185, as a means for performing calibration of the light intensity of the light-emitting unit 182 and the read voltage of the light-receiving unit 183. The reference pattern display unit 184 has a cuboid shape made with, for example, a predetermined treatment object (for example, a plain paper), and the reference pattern 185 is attached to one of the surfaces. When performing the calibration on the light-emitting unit 182 and the light-receiving unit 183, the reference pattern display unit 184 rotates so that the reference pattern 185 faces the light-emitting unit 182 and the light-receiving unit 183 side. When the calibration is not performed, the reference pattern display unit 184 rotates so that the reference pattern 185 does not face the light-emitting unit 182 and the light-receiving unit 183 side. The reference pattern 185 may have the same form as the test pattern TP or the test pattern TP1 illustrated in FIG. 19 or FIG. 20 for example.

In the first embodiment, an example is explained that the plasma energy is adjusted based on the analysis result of the dot image acquired by the pattern reading unit 180; however, the embodiment is not limited to this example. For example, a user may set the plasma energy based on the test pattern TP that is formed, at Step S106 in FIG. 16, on the treatment object 20 subjected to the plasma treatment.

Figure 22:
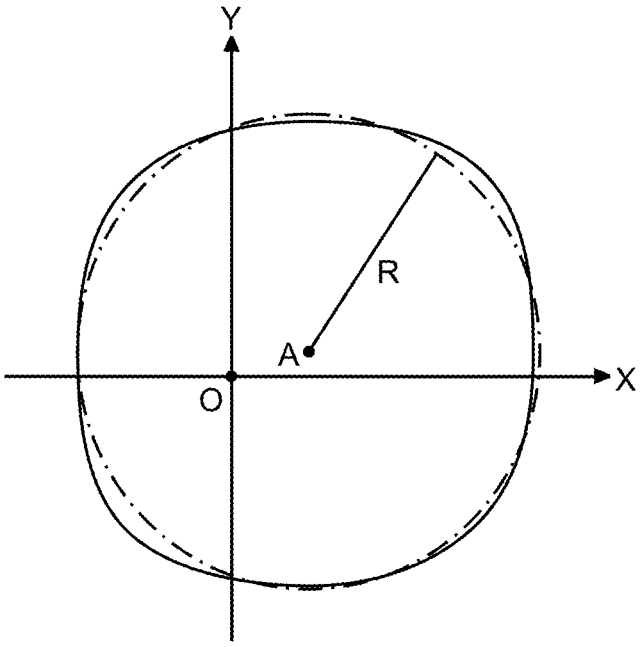
FIG. 22 is a diagram illustrating an example of a captured image of a dot according to the first embodiment.

An exemplary method to determine the size of the dot of the test pattern formed on the treatment object 20 will be explained below with reference to the drawings. To determine the size of the dot of the test pattern, the test pattern TP or TP1 as illustrated in FIG. 19 or FIG. 20 is recorded on the treatment object 20 subjected to the plasma treatment, and the pattern reading unit 180 captures images of the test pattern TP or TP1 and the reference pattern 185 to acquire a captured image of a dot (dot image) as illustrated in FIG. 22. The reference pattern 185 is located at any positions in the entire imaging region of the light receiving unit 183 (the entire imaging region of the two-dimensional sensor) illustrated in FIG. 21, and is recognized by measurement in advance. The control unit 160 compares pixels of the dot image of the acquired test pattern TP or TP1 with pixels of the dot image of the reference pattern 185, to thereby perform calibration on the dot image of the test pattern TP or TP1. In this case, a circle-like figure that is not a complete circle as illustrated in FIG. 22 (for example, the outline of the dot of the test pattern TP or TP1: a solid line) is obtained, fitting is performed on the circle-like figure by an exact circle (the outline of the dot of the reference pattern 185: a chain line). In the fitting, the least squares method is employed.

Figure 23:
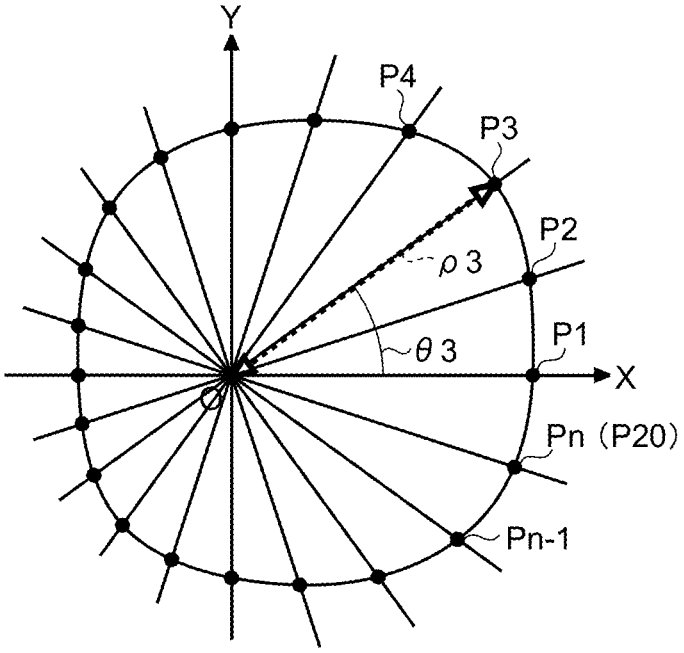
FIG. 23 is a diagram for explaining a sequence for applying a least squares method to the captured image illustrated in FIG. 22.

As illustrated in FIG. 23, in the least squares method, to quantify a deviation between the circle-like figure (solid line) and the exact circle (chain line), an origin O is taken at an approximately center position, the XY coordinates are set with respect to the origin O, and the final optimal center point A (coordinates (a, b)) and a radius R of the exact circle are obtained. Subsequently, the circumference ($2\pi$) of the circle-like figure is equally divided based on the angle, and angles $\theta_i$ with respect to the X axis and a distance $\rho_i$ from the origin O are obtained for each of data points P1 to Pn obtained by the division. If the number of the data points (i.e., the number of data sets) is assumed as "N", Equation (1) below is obtained based on trigonometric relations.

$$x_i=\rho_i \cos \theta_i$$

$$y_i=\rho_i \sin \theta_i \tag{1}$$

In this case, the optimal center point A (coordinates (a, b)) and the radius R of the exact circle are given by Equation (2) below.

$$R = \frac{\sum_{i=1}^{N} \rho_i}{N} \tag{2}$$

-continued $$a = \frac{2\sum_{i=1}^{N} x_i}{N}$$

$$b = \frac{2\sum_{i=1}^{N} y_i}{N}$$

As described above, the dot image of the reference pattern 185 is read, and the calibration is performed by comparing the dot diameter calculated by the least squares method as described above with the diameter of the reference chart. After the calibration, the dot image printed in the pattern is read and the diameter of the dot is calculated.

Furthermore, the circularity is generally represented by a difference between radii of two concentric geometric circles under conditions that the circle-like figure is sandwiched by the two concentric circles and a gap between the concentric circles is minimum. However, a ratio of the minimum diameter to the maximum diameter of a concentric circle may be defined as the circularity. In this case, if a value of the ratio of the minimum diameter to the maximum diameter becomes "1", the figure is an exact circle. The circularity can also be calculated by the least squares method by acquiring the dot image.

The maximum diameter can be obtained as a maximum distance among all distances between the center of the dot of the acquired image and each of the points on the circumference. In contrast, the minimum diameter can be calculated as a minimum distance among all distances between the center point of the dot and each of the points on the circumference.

The dot diameter and the dot circularity vary depending on the ink penetration state of the treatment object 20. In the first embodiment, the dot shape (circularity) or the dot diameter is controlled so as to reach a target value according to the type of the treatment object 20 or an ink ejection amount in order to improve the image quality. Furthermore, in the first embodiment, the formed image is read and analyzed to adjust the plasma energy for the plasma treatment such that the dot diameter for each of the ink ejection amount becomes a target dot diameter in order to achieve high image quality.

Moreover, in the first embodiment, because the pigment density in the dot can be detected based on the intensity of the reflected light, the dot image is acquired and the density in the dot is measured. By calculating the density value as a deviation distribution through a statistic calculation, density unevenness is calculated. Furthermore, by selecting the plasma energy so that the calculated density unevenness can be minimized, it becomes possible to prevent mixture of pigments due to coalescence of the dots. Therefore, it becomes possible to achieve higher image quality. It may be possible to allow a user to switch between modes, each giving a priority to control of the dot diameter, prevention of the density unevenness, or improvement of the circularity, according to the user's preference.

As described above, in the first embodiment, the plasma energy is controlled so that the unevenness of the dot circularity or the pigments in the dot can be reduced or the dot diameter becomes a target size. Therefore, it becomes possible to provide a printed material with high image quality without using a primer liquid. Moreover, even when the property of the treatment object or the print speed is changed, it is possible to stably perform the plasma treatment. Therefore, it is possible to stably perform image recording in good conditions.

In the first embodiment described above, a case has been explained that the plasma treatment is performed mainly on the treatment object. However, because the wettability of the ink with respect to the treatment object is improved by performing the plasma treatment as described above, a dot attached through the inkjet recording is spread, and therefore, an image different from an image loaded on an untreated treatment object may be recorded. This may be handled by, for example, reducing an ink ejection voltage and the size of the ink droplet at the inkjet recording when an image is to be printed on a recording medium subjected to the plasma treatment. As a result, it becomes possible to reduce the size of the ink droplet, enabling to reduce costs.

Second Embodiment

A printing apparatus and a printed material manufacturing method according to a second embodiment will be explained in detail below with reference to the drawings. In the second embodiment, the plasma energy is controlled so that the acidity (pH value) of the surface of the treatment object falls within a target range, in order to improve the circularity of an ink dot (hereinafter, simply referred to as "a dot") and to prevent coalescence of the dots so as to enhance sharpness of the dot or the a color gamut. Therefore, it becomes possible to solve an image failure, such as beading or bleed, and obtain a printed material on which a high-quality image is formed. Furthermore, by reducing and equalizing the thickness of the aggregated pigments on a printing medium, it becomes possible to reduce the size of an ink droplet, enabling to reduce ink drying energy and printing costs.

Figure 24:
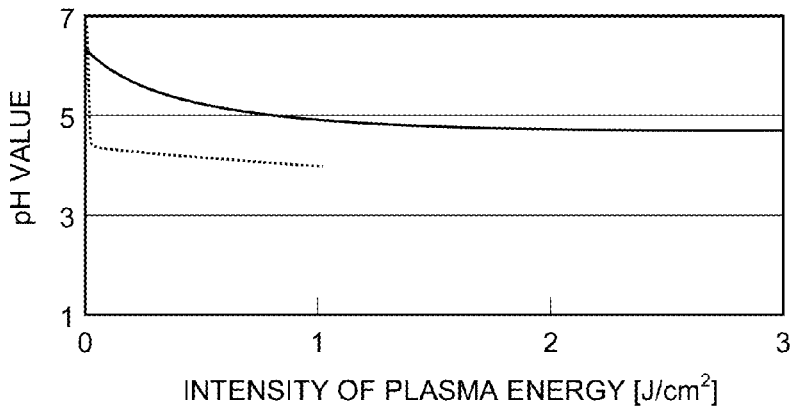
FIG. 24 is a graph showing a relationship between plasma energy and a pH according to a second embodiment.

FIG. 24 is a graph showing a relationship between the plasma energy and a pH according to the second embodiment. The pH is generally measured in solution. However, in recent years, it has become possible to measure a pH of the surface of a solid. As a measuring instrument, for example, a pH meter B-211 manufactured by HORIBA, Ltd. may be used.

In FIG. 24, a solid line represents the dependency of a pH value of a coated paper on the plasma energy, and a dashed line represents the dependency of a pH value of a PET film on the plasma energy. As illustrated in FIG. 24, the PET film is acidified at lower plasma energy than the coated paper. However, even the plasma energy for acidifying the coated paper is only about 3 J/cm$^2$ or lower. When an inkjet processing apparatus that ejects alkali aqueous pigment ink recorded an image on the treatment object 20 with the pH value of 5 or lower, the shape of a dot of the formed image became close to an exact circle. Furthermore, mixture of pigments due to coalescence of the dots did not occur and a good image without bleeding was obtained (see FIG. 7).

Figure 25:
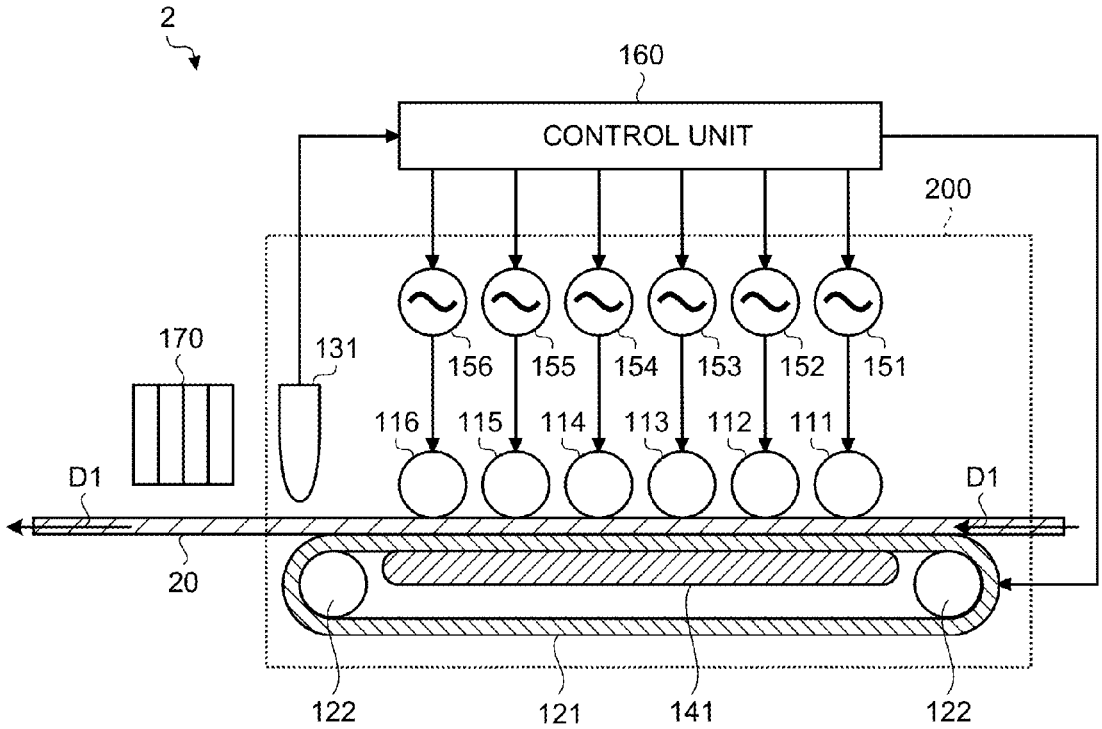
FIG. 25 is a schematic diagram illustrating a detailed configuration of components from a plasma treatment apparatus serving as an acidification treatment unit to an inkjet recording apparatus in a printing apparatus according to the second embodiment.

Therefore, in the second embodiment, a pH detecting means for a solid is provided on the downstream side of the acidification treatment unit, and information on the pH of the surface of the treatment object is read by the pH detecting means. Furthermore, feedback control or feedforward control is performed on the acidification treatment unit based on the read information on the pH in order to maintain a predetermined pH value (for example, 5 or lower) of the surface of the treatment object. FIG. 25 illustrates a detailed configuration of components from a plasma treatment apparatus serving as an acidification treatment unit and an inkjet recording apparatus in the printing apparatus according to the second embodiment. Other configurations are the same as those of the printing apparatus 1 according to the first embodiment illustrated in FIG. 3; therefore, detailed explanation thereof will be omitted.

As illustrated in FIG. 25, a printing apparatus 2 includes a plasma treatment apparatus 200 arranged on the upstream side of the conveying path D1, the inkjet head 170 arranged on the downstream side of the plasma treatment apparatus 200 in the conveying path D1, and the control unit 160 that controls each of the units of the plasma treatment apparatus 200. The inkjet head 170 ejects ink to form an image on the treatment object 20 whose surface has been acidified by the plasma treatment apparatus 200 arranged on the upstream side. The inkjet head 170 may be controlled by a separately-provided control unit (not illustrated) or may be controlled by the control unit 160.

The plasma treatment apparatus 200 further includes a pH sensor 131 disposed between the discharge electrodes 111 to 116 on the conveying path D1 and the inkjet head 170, in addition to the same configuration of the plasma treatment apparatus 100 according to the first embodiment illustrated in FIG. 15.

The pH sensor 131 measures, for example, a pH value of the surface of the treatment object 20 in a non-contact manner. The measured pH value is input to the control unit 160. The control unit 160 adjusts the number of the discharge electrodes 111 to 116 to be driven and/or the plasma energy of the pulse voltage to be supplied by each of the high-frequency high-voltage power supplies 151 to 156 to each of the discharge electrodes 111 to 116 based on the input pH value.

Figure 26:
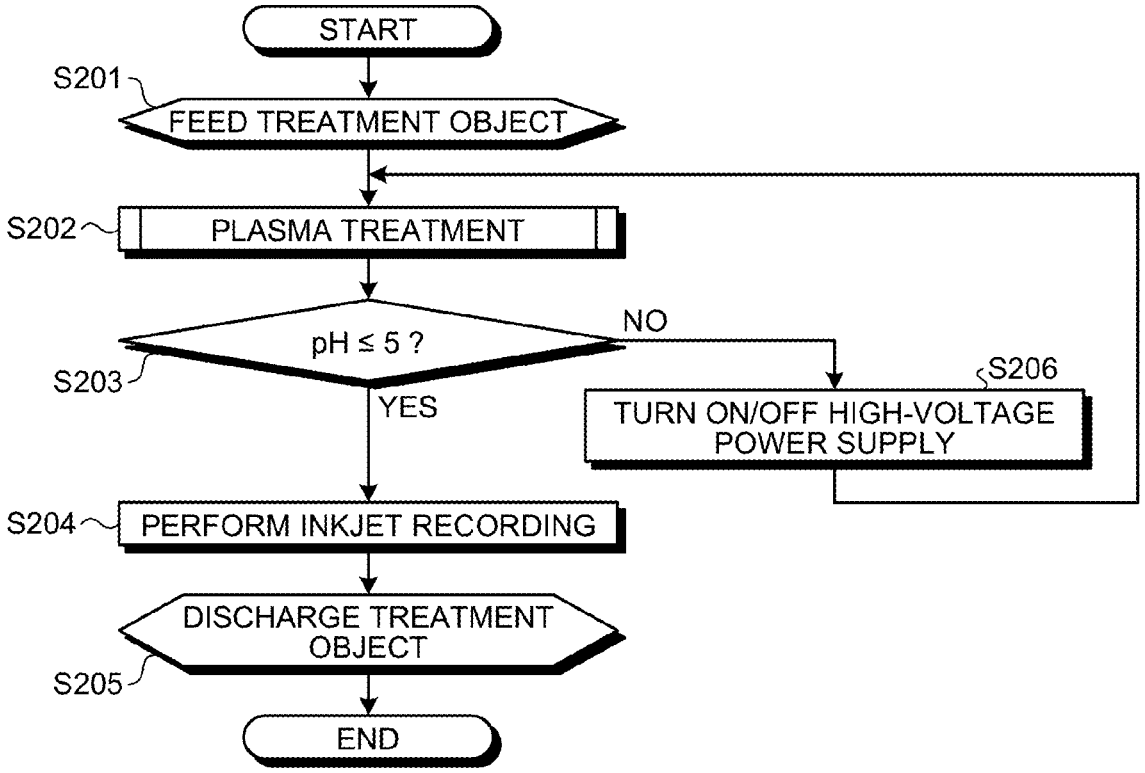
FIG. 26 is a flowchart illustrating an example of a printing process including acidification treatment according to the second embodiment.

FIG. 26 is a flowchart illustrating an example of a printing process including acidification treatment according to the second embodiment. In FIG. 26, an example is illustrated in which the printing apparatus 2 illustrated in FIG. 25 performs printing by using a cut sheet (a recording medium that is cut in a predetermined size) as the treatment object 20. The same printing process can be applied to a roll sheet that is rolled up, instead of the cut sheet.

As illustrated in FIG. 26, in the printing process, the control unit 160 drives the roller 122 in order to circulate the dielectric body 121, so that the treatment object 20 that has fed to the dielectric body 121 from the upstream side is fed into the plasma treatment apparatus 200 (Step S201). The control unit 160 drives the high-frequency high-voltage power supplies 151 to 156 in order to supply pulse voltages to the discharge electrodes 111 to 116, respectively, so that the plasma treatment is performed (Step S202). In the plasma treatment, if a detection result is not input by the pH sensor 131, the control unit 160 supplies plasma energy with predetermined intensity to the discharge electrodes 111 to 116. If the detection result is input by the pH sensor 131, the control unit 160 adjusts the number of the high-frequency high-voltage power supplies 151 to 156 to be driven based on the detected pH value. In this case, it may be possible to adjust the plasma energy supplied to each of the discharge electrodes 111 to 116.

Subsequently, the control unit 160 determines whether the pH value of the surface of the treatment object 20 is equal to or lower than a predetermined (for example, 5) based on the detection result input by the pH sensor 131 (Step S203). If the pH value is not equal to or lower than the predetermined value (NO at Step S203), the control unit 160 turns on the high-frequency high-voltage power supply 151, 152, 153, 154, 155, or 156 that has not been turned on (Step S206), and the process returns to Step S202. Consequently, the plasma energy with respect to the treatment object 20 increases, so that the pH value of the surface of the treatment object 20 subjected to subsequent plasma treatment is lowered.

In contrast, if the pH value is equal to or lower than the predetermined value (YES at Step S203), the control unit 160 drives the inkjet head 170 in order to perform the inkjet recording process on the treatment object 20 subjected to the plasma treatment (Step S204). Then, the control unit 160 discharges the treatment object 20 to the downstream side of the inkjet head 170 (Step S205), and the process ends.

Meanwhile, if the pH value is not equal to or lower than the predetermined value at Step S203, it may be possible to divert the treatment object 20 to a bypass path (not illustrated), and perform the plasma treatment again on the same treatment object 20 (Step S202). With this configuration, it becomes possible to prevent generation of a useless treatment object 20. Furthermore, even if a plurality of types of recording media with different properties are mixed in the treatment object 20, it becomes possible to perform a process in the same processing flow.

Incidentally, if a roll sheet is used as the treatment object 20, it is preferable to measure, at Step S203, a pH value after the plasma treatment by using a leading end portion of the paper that is fed by a sheet feed device (not illustrated). If the roll sheet is used, because the property of the same roll remains almost unchanged, it becomes possible to stably perform continuous printing with the same setting after the plasma energy is adjusted by using the leading end portion. However, if the use of the roll sheet is suspended for a long time before the roll sheet is used up, the property of the sheet may change. Therefore, before the printing is resumed, it is preferable to measure a pH value after the plasma treatment by using the leading end portions in the same manner as described above. Alternatively, after the pH value obtained through the plasma treatment is measured by using the leading end portion and then the plasma energy is adjusted, it may be possible to periodically or continuously measure the dot image and adjust the plasma energy. With this configuration, it becomes possible to more precisely and stably perform the control.

As described above, according to the second embodiment, it becomes possible to provide a printed material with high image quality without using a primer liquid. Furthermore, even when the property of the treatment object or the print speed is changed, it is possible to stably perform the plasma treatment. Therefore, it becomes possible to stably perform image recording in good conditions.

Third Embodiment

A third embodiment of the present invention will be explained in detail below with reference to the drawings. In the explanation below, the same components as those of the above embodiments are denoted by the same reference numerals, and the same explanation will not be repeated.

Figure 27:
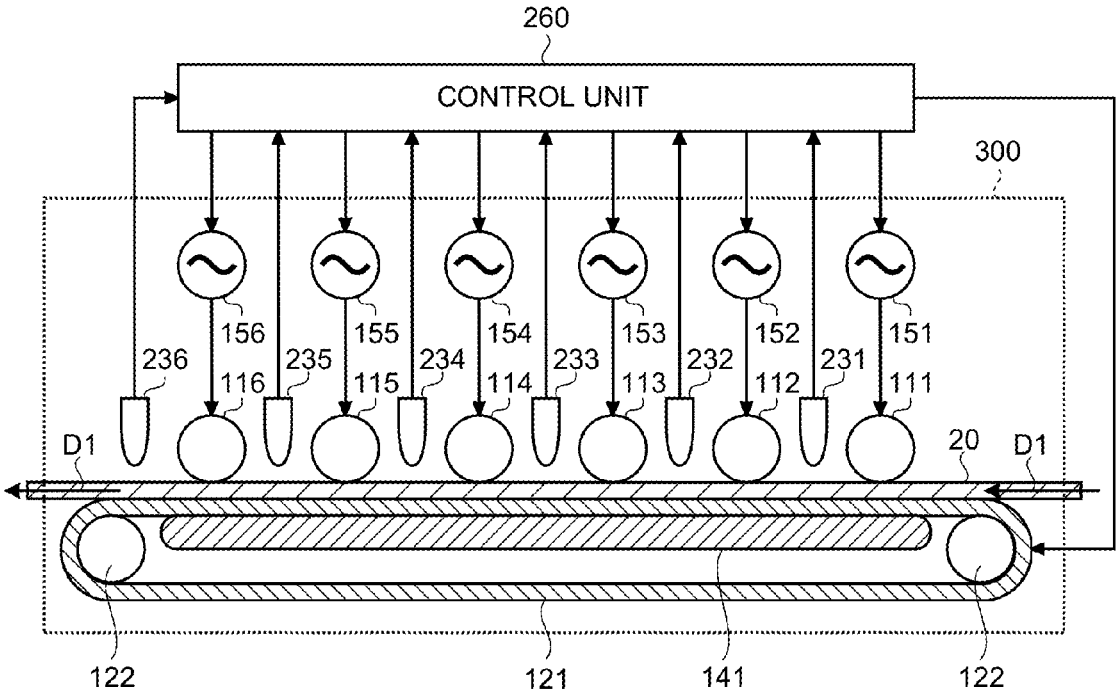
FIG. 27 is a schematic diagram illustrating a detailed configuration of a plasma treatment apparatus serving as an acidification treatment unit in a printing apparatus according to a third embodiment.

FIG. 27 illustrates a detailed configuration of a plasma treatment apparatus serving as an acidification treatment unit in a printing apparatus according to the third embodiment. The other configurations are the same as those illustrated in FIG. 2 or FIG. 25; therefore, detailed explanation thereof will be omitted.

As illustrated in FIG. 27, a plasma treatment apparatus 300 includes pH sensors 231 to 236 on the downstream sides of the discharge electrodes 111 to 116, respectively. However, the present invention is not limited to the above configuration. It is sufficient that the pH sensors 231 to 236 are disposed at least at two positions, one of which is any position between the discharge electrodes 111 to 116 and the other one of which is a position between the discharge electrode 116 located on the most downstream side and the inkjet head 170.

Information on a pH detected by each of the pH sensors 231 to 236 is input to a control unit 260. The control unit 260 drives the high-frequency high-voltage power supplies 151 to 156 on the downstream side based on the pH value obtained by the information input by each of the pH sensors 231 to 236. For example, the control unit 260 uses a detection result obtained by the pH sensor 231 located on the most upstream side to control a high-frequency high-voltage power supply located on the downstream side (for example, the high-frequency high-voltage power supply 152), so that the plasma energy to be supplied to the discharge electrode (for example, a discharge electrode 112) is adjusted. Therefore, the pH value of the surface of the treatment object 20 can accurately be controlled so as to reach a target pH value or lower.

Figure 28:
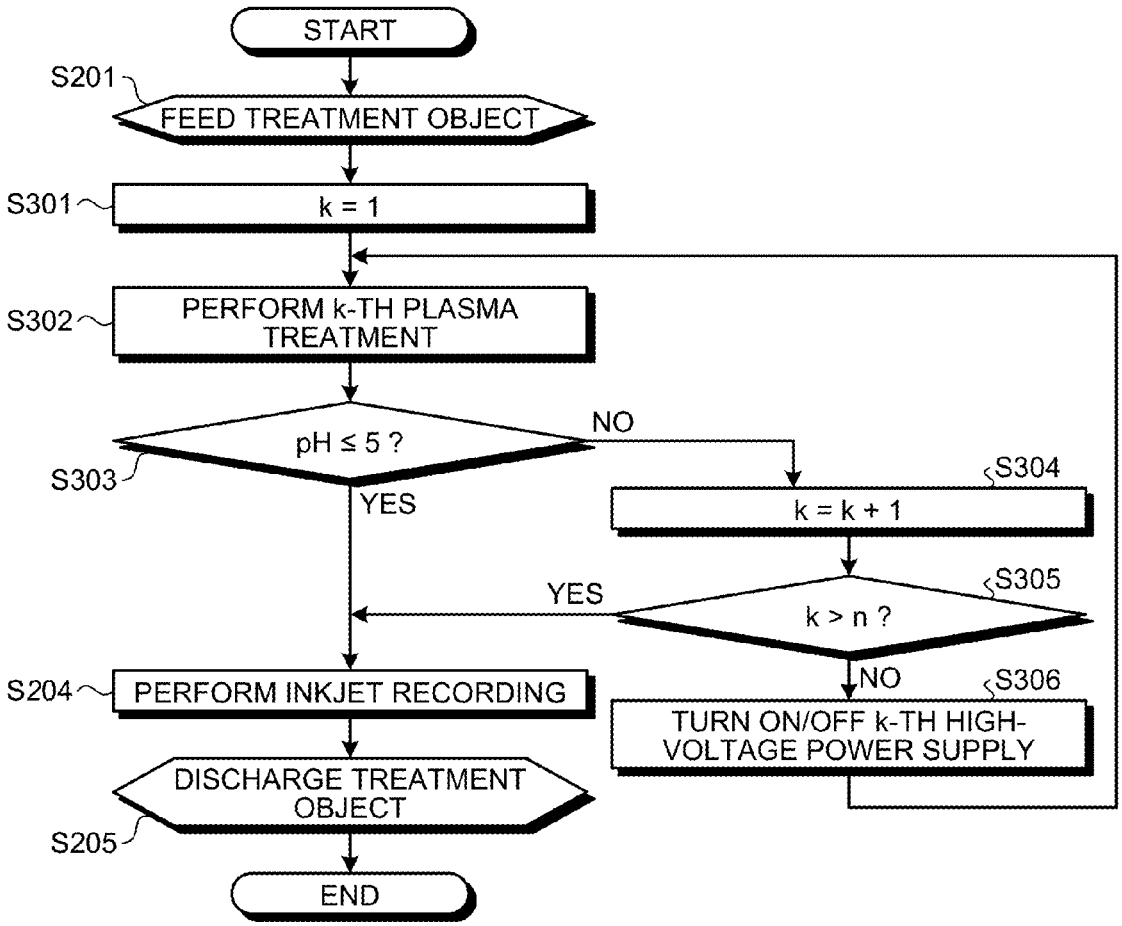
FIG. 28 is a flowchart illustrating an example of a printing process including acidification treatment according to the third embodiment.

FIG. 28 is a flowchart illustrating an example of a printing process including acidification treatment according to the third embodiment. In FIG. 28, an example is illustrated in which a printing apparatus including the plasma treatment apparatus 300 illustrated in FIG. 27 performs printing by using a cut sheet (a recording medium that is cut in a predetermined size) as the treatment object 20. The same printing process can be applied to a roll sheet that is rolled up, instead of the cut sheet.

As illustrated in FIG. 28, in the printing process, the control unit 260 drives the roller 122 in order to circulate the dielectric body 121, so that the treatment object 20 that has fed to the dielectric body 121 from the upstream side is fed into the plasma treatment apparatus 300 (Step S201). The control unit 260 assigns "1" to a value k that represents an order of each of the high-frequency high-voltage power supplies 151 to 156 from the upstream side (Step S301). Subsequently, the control unit 260 drives the high-frequency high-voltage power supply 151 to supply a pulse voltage to the discharge electrode 111, so that first plasma treatment is performed (Step S302).

The control unit 260 determines whether the pH value of the surface of the treatment object 20 is equal to or lower than a predetermined value (for example, 5) based on a detection result input by the k-th pH sensor from the upstream side (in this example, the first pH sensor, i.e., the pH sensor 231) (Step S303). If the pH value is not equal to or lower than the predetermined value (NO at Step S303), the control unit 260 adds 1 to the value k (Step S304), and determines whether the obtained value (k=k+1) is greater than n (in this example, 6) that represents the number of the high-frequency high-voltage power supplies 151 to 156 (Step S305).

If the value k is equal to or lower than n (NO at Step S305), the control unit 260 turns on the k-th high-frequency high-voltage power supply from the upstream side (for example, the high-frequency high-voltage power supply 152) (Step S306), and the process returns to Step S302. Therefore, the total plasma energy with respect to the treatment object 20 increases, so that the pH value of the surface of the treatment object 20 decreases.

If the pH value is equal to or lower than the predetermined value (YES at Step S303), or if the value k is greater than n (YES at Step S305), the control unit 260 drives the inkjet head 170 to perform the inkjet recording process on the treatment object 20 subjected to the plasma treatment (Step S204). Subsequently, the control unit 260 conveys the treatment object 20 to the downstream side of the inkjet head 170 (Step S205), and the process ends.

As described above, according to the third embodiment, it becomes possible to adjust the pH value of the surface of the treatment object 20 to a target pH value or lower with higher accuracy than in the second embodiment. The other configurations, operations, and advantageous effects are the same as those explained in the above embodiments; therefore, detailed explanation thereof will be omitted.

In the third embodiment descried above, a case has been explained that the plasma treatment is performed mainly as the acidification treatment on the treatment object. However, because the wettability of the ink with respect to the treatment object is improved by performing the plasma treatment as described above, a dot attached through the inkjet recording is spread, and therefore, an image different from an image loaded on an untreated treatment object may be recorded. This may be handled by, for example, reducing an ink ejection voltage and the size of the ink droplet at the inkjet recording when an image is to be printed on a recording medium subjected to the plasma treatment. As a result, it becomes possible to reduce the size of the ink droplet, enabling to reduce costs.

Figure 29:
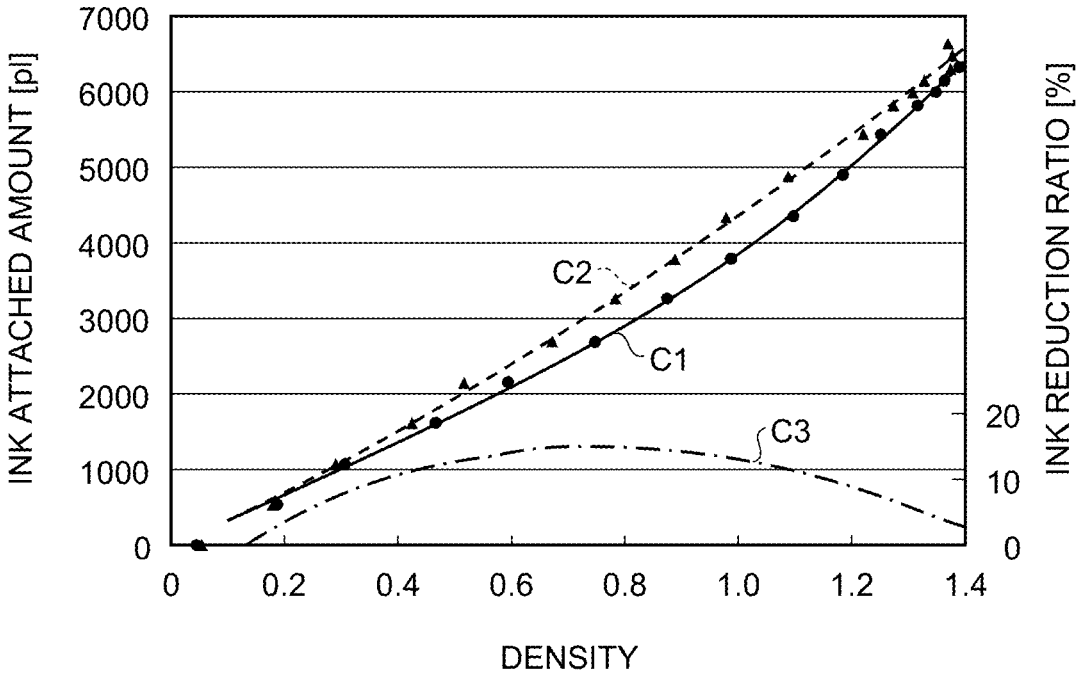
FIG. 29 is a graph showing a relationship between an ink ejection amount and image density according to the embodiment.

FIG. 29 is a graph showing a relationship between an ink ejection amount and image density according to the embodiments described above. In FIG. 29, a solid line C1 represents a relationship between the ink ejection amount and the image density when the inkjet recording process is performed on a treatment object that is not subjected to the plasma treatment according to the embodiments, a broken line C2 represents a relationship between the ink ejection amount and the image density when the inkjet recording process is performed on a treatment object that is subjected to the plasma treatment according to the embodiments, and a chain line C3 represents an ink reduction ratio of the broken line C2 to the solid line C1.

As is evident from comparison of the solid line C1 and the broken line C2 in FIG. 29 and from a chain line C3, by performing the plasma treatment according to the embodiments on the treatment object 20 before the inkjet recording process, it becomes possible to reduce the ink ejection amount needed to obtain the same image density because of the effect of the improvement in the dot circularity, spread of the dot, or the uniformity of the pigment density in the dot.

Furthermore, by performing the plasma treatment according to the embodiments on the treatment object 20 before the inkjet recording process, the thickness of the pigment attached to the treatment object 20 can be reduced, so that saturation can be improved and a color gamut can be enhanced. Because the amount of the ink is reduced, energy for drying the ink can also be reduced, so that it becomes possible to achieve an energy-saving effect.

Moreover, while an example is explained in the embodiments that the target pH value of the surface of the treatment object 20 is set to 5 or lower, this is by way of example only. Specifically, an ideal pH value that enables to improve the wettability or the permeability of each treatment object and the aggregability of ink pigments may differ depending on components of the ink, a type of the ink, or a change in the treatment object. Therefore, it may be possible to obtain the plasma energy or the target pH value in advance as optimal conditions for each type of the ink or each type of the treatment object, and may register the optimal conditions in the control unit.

Incidentally, it may be possible to apply, to the surface of a printing material, discharge plasma that is produced by ionizing an atmosphere gas by discharge before the inkjet recording process. As described above, by performing a hydrophilization process on the printing material before the inkjet recording process, the wettability of the surface of the treatment object can be improved, so that the circularity of the dot formed through the inkjet recording process can be improved. Besides, it becomes possible to reduce a time to dry the vehicle, enabling to reduce occurrence of the beading.

Furthermore, in the embodiments, the inkjet head used for image recording and the discharge electrode used for the plasma treatment are provided separately, the present invention is not limited to this configuration. For example, as a first modification illustrated in FIG. 30 and FIG. 31, it may be possible to mount the inkjet head 170 and a discharge electrode 110 on the same conveyor (hereinafter, referred to as "a carriage").

Figure 30:
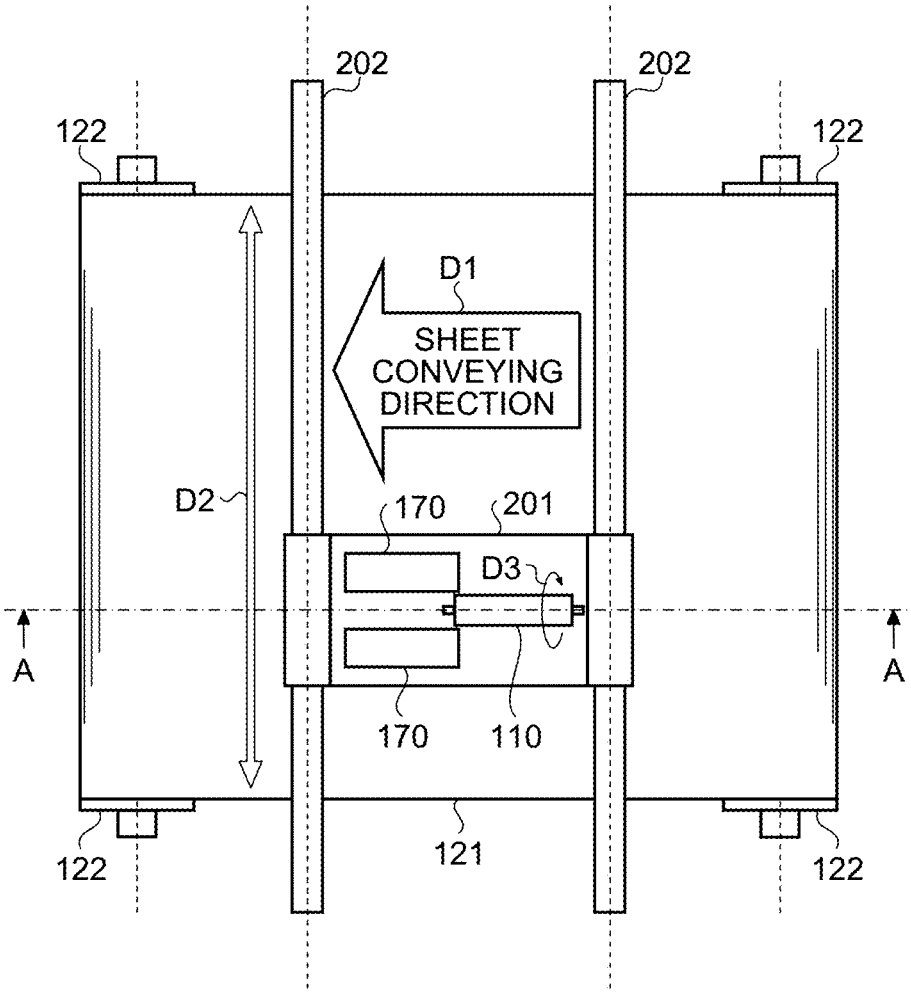
FIG. 30 is a schematic diagram illustrating a detailed configuration of components from a plasma treatment apparatus to an inkjet recording apparatus in a printing apparatus according to a first modification of the embodiment.
Figure 31:
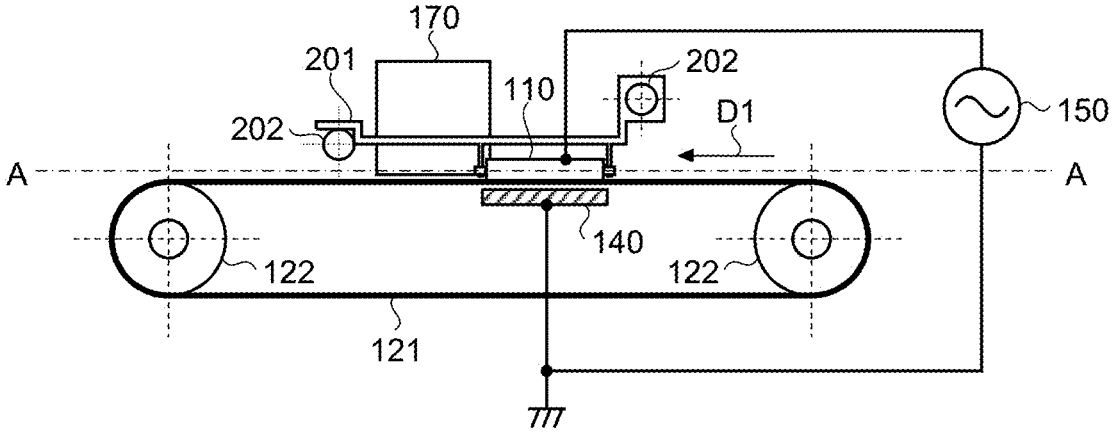
FIG. 31 is a cross-sectional view taken along A-A in FIG. 30.

The configuration according to the first modification illustrated in FIG. 30 and FIG. 31 will be explained in detail below. FIG. 30 and FIG. 31 illustrate a configuration example, in which the components from the plasma treatment apparatus 100 to the inkjet head 170 illustrated in FIG. 15 are selectively illustrated and the inkjet head 170 is incorporated inside the plasma treatment apparatus 100. Furthermore, for simplicity of explanation, FIG. 30 and FIG. 31 illustrate an example in which one set of the discharge electrode 110, a ground electrode 140, and a high-frequency high-voltage power supply 150 is mounted on a single carriage 201; however, the present invention is not limited thereto. For example, it may be possible to mount a plurality of sets of the discharge electrodes (for example, the discharge electrodes 111 to 116), the ground electrodes (for example, the ground electrodes 141 to 146), and the high-frequency high-voltage power supplies (for example, the high-frequency high-voltage power supplies 151 to 156) on a single or multiple carriages 201. Moreover, in the example in FIG. 30 and FIG. 31, the two inkjet heads 170 are mounted on the single carriage 201.

As illustrated in FIG. 30 and FIG. 31, in the first modification, the two inkjet heads 170 and the single discharge electrode 110 are mounted on the single carriage 201. The discharge electrode 110 has a roller shape and is supported so as to rotate in a D3 direction with respect to the carriage 201 for example. However, the present invention is not limited to this example and it may be possible to employ a discharge electrode fixed with a narrow gap with respect to the recording medium.

The carriage 201 is slidably mounted on two guide rods 202 that are arranged parallel to each other along the scanning direction D2 of the inkjet heads 170. The inkjet heads 170 and the discharge electrode 110 are fixed to the carriage 201 and move in the scanning direction D2 along with the movement of the carriage 201 in the scanning direction D2. The scanning direction D2 is, for example, perpendicular to the conveying path D1.

A ground electrode (also referred to as a counter electrode) 140 is arranged at a position opposing the discharge electrode 110 across the dielectric body 121 that is an endless belt. For example, the ground electrode 140 may be arranged so as to be opposed to the entire moving range of the discharge electrode 110, or may have the same size or a slightly larger size with respect to the ground electrode 140 and move along with the movement of the discharge electrode 110, that is, along with the movement of the carriage 201.

With this configuration, by causing an ink supply unit (not illustrated) to supply ink to the inkjet heads 170, and causing the carriage 201 to run while dropping (ejecting) the ink from the inkjet heads 170, an image is formed on the treatment object 20 being conveyed on the dielectric body 121.

Operation of the printing apparatus according to the first modification will be explained below. Specifically, operation for image formation and surface modification (the plasma treatment) will be described. Other operation may be the same as the operation described in the above embodiments.

The treatment object 20 fed by the sheet feed unit (not illustrated) is conveyed by the dielectric body 121 (the conveying belt) along the conveying path D1. When the treatment object 20 is conveyed to a location below the discharge electrode 110, the conveyance of the treatment object 20 is stopped. Then, the high-frequency high-voltage power supply 150 supplies a high-frequency high-voltage pulse voltage to between the discharge electrode 110 and the ground electrode 140, and at the same time, the carriage 201 moves along the scanning direction D2. Therefore, the atmospheric pressure non-equilibrium plasma generated between the electrodes moves to the scanning direction D2. As a result, the surface of the treatment object 20 on the discharge electrode 110 side is subjected to the plasma treatment Subsequently, the treatment object 20 is conveyed to a location just below the inkjet heads 170 by the dielectric body 121 (the conveying belt) and then the conveyance is stopped. In this state, by dropping the ink from the inkjet heads 170 while causing the carriage 201 to keep running, an image corresponding to a write width of the inkjet heads 170 is formed on the treatment object 20. Furthermore, the high-frequency high-voltage power supply 150 applies a high-frequency high-voltage pulse voltage to between the discharge electrode 110 and the ground electrode 140 simultaneously with the image formation, so that the plasma treatment is performed on a region where a next image is formed.

Thereafter, the plasma treatment and the image formation can be performed on the treatment object 20 by repeating the same operation.

As a second modification, an example will be explained below that the inkjet heads and the discharge electrode are caused to run individually.

Figure 32:
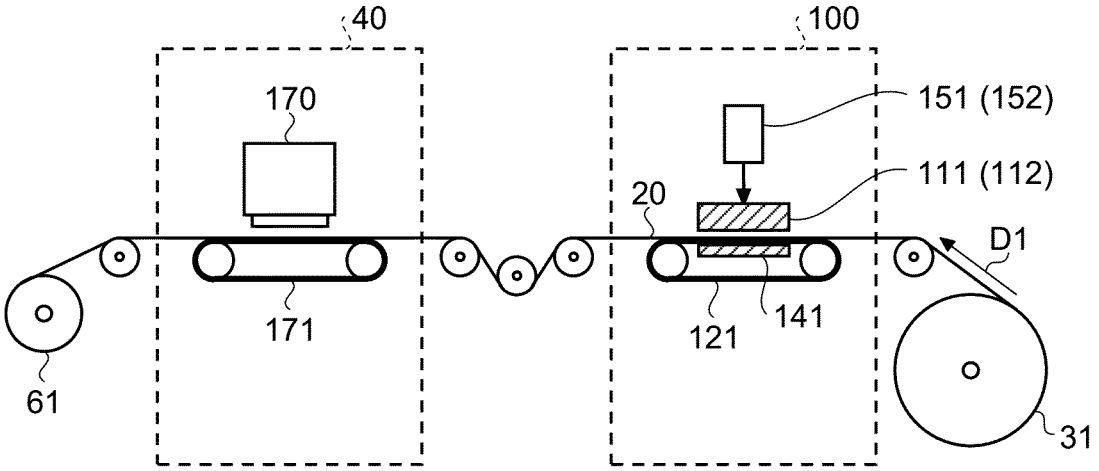
FIG. 32 is a schematic diagram illustrating a configuration of an inkjet head and a discharge electrode that are separately arranged according to a second modification of the embodiment.
Figure 33:
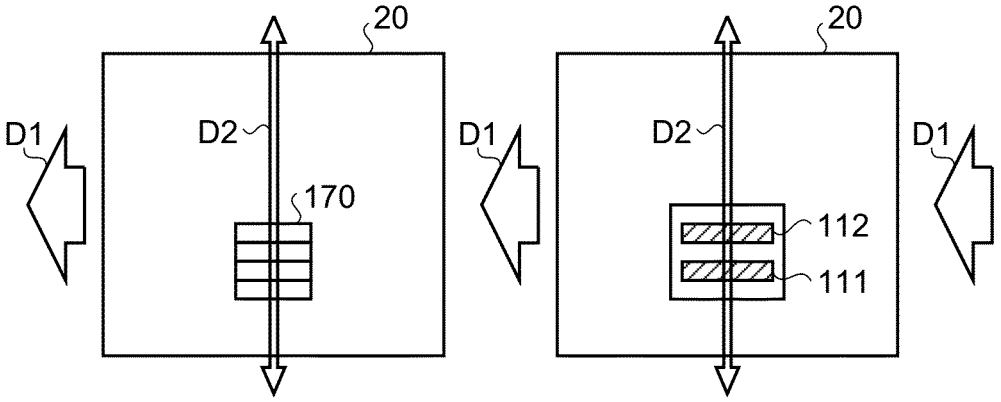
FIG. 33 illustrates an image formation area and a plasma treatment area viewed from above in FIG. 32.
Figure 34:
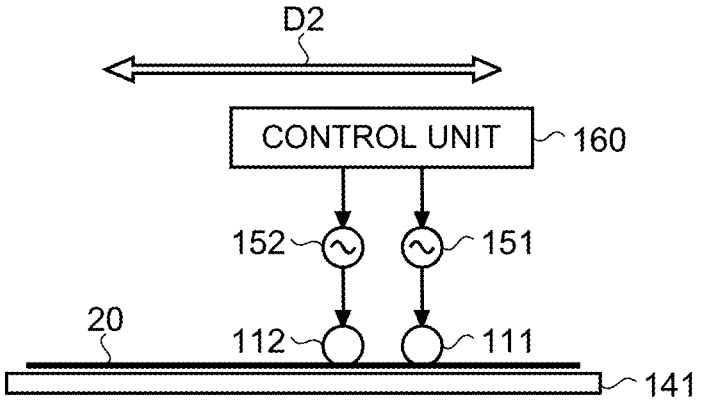
FIG. 34 is a schematic diagram illustrating a configuration of a plasma treatment apparatus according to the second modification of the embodiment when plasma treatment is performed.
Figure 35:
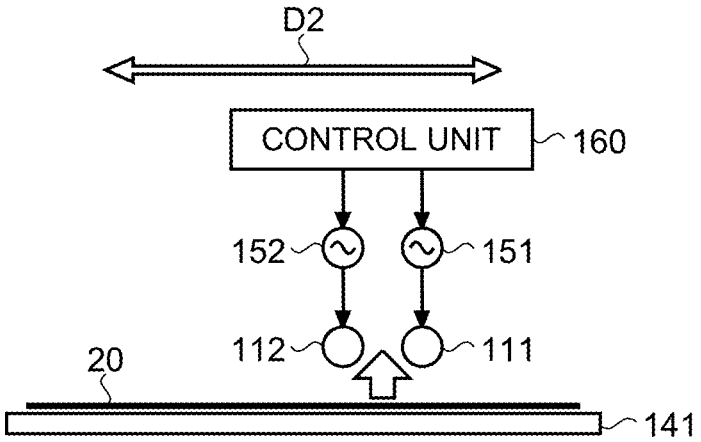
FIG. 35 is a schematic diagram illustrating a configuration of the plasma treatment apparatus according to the second modification of the embodiment when a treatment object is conveyed.

FIG. 32 is a schematic diagram illustrating a configuration according to the second modification, in which the inkjet head and the discharge electrodes are provided separately. FIG. 33 is a top view illustrating an image formation area and a plasma treatment area in FIG. 32. FIG. 34 is a schematic diagram illustrating a configuration of the plasma treatment apparatus 100 of the second modification when the plasma treatment is performed. FIG. 35 is a schematic diagram illustrating a configuration of the plasma treatment apparatus 100 of the second modification when the treatment object is conveyed.

As illustrated in FIG. 32 and FIG. 33, in the second modification, the plasma treatment apparatus 100 and the image forming unit 40 are separately provided. The running direction of the discharge electrodes 111 and 112 in the plasma treatment apparatus 100 is the same as the scanning direction D2 perpendicular to the conveying path D1, similarly to the first modification.

With this configuration, the treatment object 20 (the recording medium) that is rolled up is conveyed from the sheet feed roller 31 to a location below the discharge electrodes 111 and 112 of the plasma treatment apparatus 100. Then, in the plasma treatment apparatus 100, the high-frequency high-voltage power supplies 151 and 152 supply high-frequency high-voltage pulse voltages to the discharge electrodes 111 and 112, respectively, and the discharge electrodes 111 and 112 are caused to run in the scanning direction D2 along with movement of a carriage (not illustrated). Therefore, the atmospheric pressure non-equilibrium plasma generated between the discharge electrodes 111 and 112 and the ground electrode 141 moves in the scanning direction D2, so that the surface of the treatment object 20 is subjected to the plasma treatment.

However, if a rotatable roller type electrode is used as each of the discharge electrodes 111 and 112 as in the second modification, as illustrated in FIG. 34, the discharge electrodes 111 and 112 come in contact with the treatment object 20 when the plasma treatment is performed. Therefore, it is impossible to convey the treatment object 20 during the plasma treatment. To cope with this, when the treatment object 20 is conveyed, as illustrated in FIG. 35, the discharge electrodes 111 and 112 are moved to an upper side or a lateral side to separate the discharge electrodes 111 and 112 from the treatment object 20. The separated discharge electrodes 111 and 112 may be located at positions deviated outward (to the lateral side) from the treatment object 20 in the width direction of the treatment object 20, positions above the treatment object 20, or positions on an upper and outer lateral side of the treatment object 20. Meanwhile, as a method to move the discharge electrodes 111 and 112 upward, for example, it may be possible to elevate the guide rods 202 of the first modification by a cam mechanism (not illustrated). Furthermore, the configuration for moving the discharge electrodes to convey the treatment object 20 may be applied to the first modification described above.

As described above, the treatment object 20 subjected to the plasma treatment is conveyed by a distance corresponding to the plasma treatment area (the width of the electrode or smaller in the conveying direction D1) and then stopped again, so that the next area is subjected to the plasma treatment. By repeating the above operation, the surface of the treatment object 20 is subjected to the plasma treatment. The treatment object 20 subjected to the plasma treatment is sequentially conveyed to the image forming unit 40.

In the image forming unit 40, the treatment object 20 subjected to the plasma treatment is conveyed to the inkjet heads 170 and then stopped. In this state, by moving the carriage on which the inkjet heads 170 are mounted in the scanning direction D2 while causing the inkjet heads 170 to drop the ink, an image corresponding to the write width of the inkjet heads 170 is formed on the treatment object 20. The treatment object 20 on which the image is formed as described above is conveyed by the amount corresponding to the image formation area (the width of the head or smaller in the conveying direction D1) and then stopped again, so that an image is formed on the next region.

Thereafter, the plasma treatment and the image formation are performed on the treatment object 20 by repeating the same operation.

While exemplary embodiments of the present invention are explained in detail above, the present invention is not limited to the above embodiments. Therefore, various modifications may be made within the scope of the present invention.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed:

1. A printing apparatus comprising:

a plasma treatment unit that performs plasma treatment on a surface of a treatment object to acidify at least the surface of the treatment object; and a recording unit that performs inkjet recording on the surface of the plasma treatment subjected to the plasma treatment by the plasma treatment unit;

wherein an ink attached to the surface of the treatment object by the recording unit is an aqueous ink.

2. The printing apparatus according to claim 1, further comprising:

a reading unit configured to read an image that is formed on the treatment object through the inkjet recording; and a control unit configured to adjust plasma energy of the plasma treatment unit based on the image read by the reading unit.

3. The printing apparatus according to claim 1, further comprising:

a storage unit that stores therein plasma energy for the plasma treatment and a type of the treatment object in an associated manner; and a control unit configured to adjust plasma energy of the plasma treatment unit based on the type of the treatment object.

4. The printing apparatus according to claim 1, further comprising:

a storage unit unit that stores therein plasma energy for the plasma treatment and a size of an ink droplet for a dot in an associated manner; and a control unit configured to adjust plasma energy of the plasma treatment unit based on the size of the ink droplet.

5. The printing apparatus according to claim 1, further comprising:

a storage unit that stores therein plasma energy for the plasma treatment and a print mode an associated manner; and a control unit configured to adjust plasma energy of the plasma treatment unit based on the print mode.

6. The printing apparatus according to claim 1, further comprising:

a detector configured to detect a pH value of the surface of the treatment object subjected to acidification by the plasma treatment unit; and a control unit configured to adjust plasma energy of the plasma treatment unit based on a detection result obtained by the detector.

7. The printing apparatus according to claim 1, further comprising:

a control unit configured to adjust plasma energy, wherein the plasma treatment unit includes a plurality of discharge electrodes, and the control unit adjusts the plasma energy by adjusting a number of the discharge electrodes to be used for the plasma treatment among all of the discharge electrodes.

8. The printing apparatus according to claim 1, further comprising:

a control unit configured to adjust plasma energy, wherein the plasma treatment unit includes a power supply and a discharge electrode, and the control unit adjusts the plasma energy by adjusting at least one of a frequency and a voltage vale of a pulse voltage to be supplied by the power supply to the discharge electrode.

9. The printing apparatus according to claim 1, wherein the plasma treatment unit is atmospheric pressure non-equilibrium plasma treatment.

10. The printing apparatus according to claim 1, wherein the plasma treatment unit performs plasma treatment on the surface of a treatment object to increase a penetration ratio of at least the surface of the treatment object.

11. The printing apparatus according to claim 1, wherein the treatment object is coated paper including a coated layer on a surface thereof.

12. The printing apparatus according to claim 1, wherein the plasma treatment unit includes a discharge electrode, a ground electrode, and a dielectric body disposed between the discharge electrode and the ground electrode, and when the treatment object exists between the discharge electrode and the dielectric body, the plasma treatment unit performs the plasma treatment on the treatment object using dielectric barrier discharge.

13. The printing apparatus according to claim 1, wherein acidifying at least the surface of the treatment object causes a concentration of hydrogen ion on at least the surface of the treatment object to increase depending on a property of ink ejected by the recording unit.

14. The printing apparatus according to claim 1, further comprising:

a conveying unit that conveys the treatment object; and a plasma control unit configured to adjust plasma energy applied to the surface of the treatment object by changing of conveying speed of the treatment object by the conveying unit.

15. The printing apparatus according to claim 1, further comprising:

a conveying unit that conveys the treatment object; and a carriage that moves in a direction perpendicular to a conveying direction of the treatment object, wherein the plasma treatment unit is mounted on the carriage.

16. The printing apparatus according to claim 1, wherein an ink attached to the surface of the treatment object by the recording unit is an ink in which negatively-charged pigments are dispersed in a liquid.

17. A printed material manufacturing method comprising:

performing plasma treatment with a plasma treatment unit on a surface of a treatment object to acidify at least the surface of the treatment object; and performing inkjet recording on the surface of the plasma treatment subjected to the plasma treatment by the plasma treatment unit;

wherein an ink attached to the surface of the treatment object by the recording unit is an aqueous ink.

18. A printing system comprising:

a plasma treatment unit that performs plasma treatment on a surface of a treatment object to acidify at least the surface of the treatment object; and a recording unit that performs inkjet recording on the surface of the plasma treatment subjected to the plasma treatment by the plasma treatment unit;

wherein an ink attached to the surface of the treatment object by the recording unit is an aqueous ink.

* * * * *